US011470984B1

(12) United States Patent
Wright et al.

(10) Patent No.: US 11,470,984 B1
(45) Date of Patent: Oct. 18, 2022

(54) RECONFIGURABLE INFANT SUPPORT STRUCTURE

(71) Applicant: Mattel, Inc., El Segundo, CA (US)

(72) Inventors: Kyle Wright, Springville, NY (US); Juliana Lacoste, Elma, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 17/381,299

(22) Filed: Jul. 21, 2021

(51) Int. Cl.
*A47D 13/10* (2006.01)

(52) U.S. Cl.
CPC ..... *A47D 13/107* (2013.01)

(58) Field of Classification Search
CPC ..... A47D 13/107; A47D 1/006; A47D 11/00; A47D 1/10; A47D 1/06; B62B 7/12
USPC ..... 297/181, 274, 273, 133, 130, 281
See application file for complete search history.

(56) References Cited

U.S. PATENT DOCUMENTS 16,942 A * 3/1857 Wellman ..... A47D 13/107 297/188.08
587,845 A * 8/1897 Mitchell ..... A47D 1/10 297/130
835,819 A * 11/1906 Easley ..... A47D 9/02 5/127
851,249 A * 4/1907 Niemeyer ..... A47D 13/105 297/130
2,530,474 A * 11/1950 Lutes ..... A47K 11/04 297/133
D168,910 S * 2/1953 Reedy ..... 297/181
3,692,359 A 9/1972 Boucher
4,093,208 A * 6/1978 Tomalinas, Jr. ..... A63G 13/10 280/87.051
4,382,595 A * 5/1983 Tolar ..... A63G 9/00 297/275
D305,108 S 12/1989 Blumenthal
D403,715 S 1/1999 Keegan et al.
D417,417 S 12/1999 Keegan et al.
6,080,028 A * 6/2000 Wen ..... B63B 34/565 441/131
6,231,056 B1 5/2001 Wu
D587,764 S 3/2009 Cheng
D612,302 S 3/2010 Cheng
D627,009 S 11/2010 Lu
D679,337 S 4/2013 Lai
D694,676 S 12/2013 Lai
D750,534 S 3/2016 Lu
D765,557 S 9/2016 Cheng
(Continued)

*Primary Examiner* — Milton Nelson, Jr.
(74) *Attorney, Agent, or Firm* — Edell, Shapiro & Finnan, LLC

(57) ABSTRACT

An infant support structure may include a frame, a first portion, and a second portion. The first portion may contain a seat configured to receive an infant. The first portion may be movably coupled to the frame via a resilient member. The resilient member may suspend the first portion above a support surface and facilitate movement of the first portion with respect to the frame. The second portion may be removably coupled to the first portion. When coupled to the first portion, the second portion may also be suspended above a support surface, and the infant support structure may provide a first play pattern to the infant. When uncoupled from the first portion, the second portion may be disposed on the support surface while the first portion remains suspended above the support surface, and the second portion may provide a second play pattern.

20 Claims, 30 Drawing Sheets

(56) References Cited

U.S. PATENT DOCUMENTS

| | | | | |
|---|---|---|---|---|
| D771,524 | S | 11/2016 | Lu | |
| 9,610,211 | B2 | 4/2017 | Lai | |
| 9,701,331 | B2 | 7/2017 | Burns et al. | |
| 10,000,225 | B2 | 6/2018 | Burns et al. | |
| 10,021,994 | B1 | 7/2018 | Lu | |
| D847,035 | S | 4/2019 | Lu | |
| 10,244,872 | B2 * | 4/2019 | Thomson | A47D 1/004 |
| 10,442,451 | B2 | 10/2019 | Burns et al. | |
| 2016/0288813 | A1 | 10/2016 | Burns et al. | |
| 2017/0065099 | A1 | 3/2017 | Burns et al. | |
| 2017/0282951 | A1 | 10/2017 | Burns et al. | |
| 2018/0297623 | A1 | 10/2018 | Burns et al. | |

* cited by examiner

RECONFIGURABLE INFANT SUPPORT STRUCTURE

TECHNICAL FIELD

The present disclosure is directed towards an infant support structure that enables infants to perform jumping motions. More specifically, the present disclosure is directed to an infant jumping device that is reconfigurable to enable various play/use patterns by an infant.

BACKGROUND OF THE INVENTION

Various types of infant support structures exist for infants and children to promote the development of large motor skills, such as walking or jumping. These infant support structures typically only have one type of play pattern or use. For example, infant jumpers typically only provide the play pattern of facilitating a jumping motion for the infant in order for them to develop large motor skills with their legs and balance. Because it is desirable for infants to develop multiple skills as they grow, parents are often required to purchase multiple infant play/support structures that are each targeted to specific play patterns/uses. These infant play/support structures include, but are not limited to, infant walkers, infant jumpers, infant seats, infant swings, infant gliders, play centers, etc. Each one of these infant play/support structures requires space for use and storage. Parents who own multiple infant play/support structures often find themselves burdened by the cost of purchasing multiple infant play/support structures, as the purchase of multiple infant play/support structures can be costly. In addition to the cost burdens, having to own multiple infant play/support structures also creates a space burden on parents since each of the infant play/support structures take up a significant amount of space within a home, even if they are capable of being placed in a storage configuration.

Therefore, what is needed is an infant play/support structure that is capable of multiple play patterns/uses that facilitate the development of multiple different skill sets for infants. Furthermore, any conversion of the infant play/support structure to enable the different play patterns/uses should be relatively quick and easy for a caretaker to perform. Moreover, any conversion of the infant play/support structure to enable the different play patterns/uses must incorporate safety features that prevent injury of an infant and are safe for the infant to use.

SUMMARY OF THE INVENTION

The present disclosure is directed toward a reconfigurable infant support structure that is at least configured to facilitate a jumping motion by an infant. The infant support structure may include a frame, a first portion, and a second portion. The first portion may contain a seat configured to receive an infant. The first portion may be movably coupled to the frame via at least one resilient member. The at least one resilient member may be configured to suspend the first portion above a support surface and facilitate movement of the first portion with respect to the frame. The second portion may be removably coupled to the first portion. When coupled to the first portion, the second portion may also be suspended above a support surface, and the infant support structure may provide a first play pattern to the infant. When uncoupled from the first portion, the second portion may be disposed on the support surface while the first portion remains suspended above the support surface. When uncoupled, the second portion may provide a second play pattern where the second portion may surround an infant disposed on the support surface.

According to one embodiment, the infant support structure presented herein may include a frame, a first portion, a second portion, and at least one resilient member. The first portion may contain a seat that is configured to receive an infant. The at least one resilient member may couple the first portion to the frame such that the at least one resilient member facilitates movement of the first portion with respect to the frame. The second portion may be removably coupled to the first portion. When the second portion is coupled to the first portion, the second portion may be suspended above a support surface. When the second portion is uncoupled from the first portion, the second portion may be disposed on the support surface.

In at least some instances, when the second portion is coupled to the first portion, the second portion may be disposed underneath the first portion and the at least one resilient member may be configured to facilitate movement of the second portion with respect to the frame. In some further instances, the second portion may be shaped like that of a toy vehicle, and may be configured to receive an infant (i.e., an infant may be placed or disposed within the second portion) when the second portion is uncoupled from the first portion and disposed on the support surface. In at least some further instances, the infant support structure may include a latch mechanism that removably couples the second portion to the first portion, where the latch mechanism may further require a dual actuation to facilitate the uncoupling of the second portion from the first portion. Additionally, the latch mechanism may be operatively disposed within the second portion.

According to another embodiment, the infant support structure presented herein may include a frame, a seat support, and an interactive assembly. The seat support may be configured to receive an infant, and may be suspended from the frame above a support surface. The interactive assembly may be removably coupled to the seat support. When the interactive assembly is coupled to the seat support, the interactive assembly may be configured to provide a first play pattern. When the interactive assembly is uncoupled from the seat support, the interactive assembly may provide a second play pattern and may be disposed on the support surface. Furthermore, when the interactive assembly is uncoupled from the seat support and disposed on the support surface, the interactive assembly may be configured to surround an infant disposed on the support surface (i.e., an infant may be placed or disposed within the interactive assembly).

In some instances, the seat support may be suspended from the frame via a resilient member that may be configured to facilitate movement of the seat support with respect to the frame. In some further instances, when the interactive assembly is coupled to the seat support, the resilient member may be further configured to facilitate movement of the interactive assembly with respect to the frame. In still some further instances, the interactive assembly may be in the shape of a toy vehicle that may be configured to receive an infant when the interactive assembly is uncoupled from the seat support and disposed on the support surface (i.e., an infant may be placed or disposed within the interactive assembly). Additionally, in some instances, the infant support structure may further include a latch mechanism that may removably couple the interactive assembly to the seat support. The latch mechanism may be operatively disposed within the interactive assembly.

According to yet another embodiment, the infant support structure presented herein may include a frame, a seat support, and an interactive assembly. The seat support may be configured to receive an infant, and may be suspended from at least a portion of the frame such that the seat support is suspended above a support surface. The interactive assembly may be removably coupled to the seat support. The infant support structure may be reconfigurable between a first configuration and a second configuration. When in the first configuration, the interactive assembly may be coupled to the seat support such that the interactive assembly is suspended above the support surface. When in the second configuration, the seat support may remain suspended above the support surface, and the interactive assembly may be uncoupled from the seat support and disposed on the support surface. In some instances, the seat support may be suspended from the portion of the frame via a resilient member that may be configured to facilitate movement of the seat support with respect to the frame. In some further instances, when the infant support structure is in the first configuration, the resilient member may be further configured to facilitate movement of the interactive assembly with respect to the frame. In some even further instances, the interactive assembly may be in the shape of a toy vehicle that may be configured to receive an infant when the interactive assembly is uncoupled from the seat support and disposed on the support surface. Moreover, in still some further instances, the infant support structure may include a latch mechanism that removably couples the interactive assembly to the seat support, where the latch mechanism may require a dual actuation to facilitate the uncoupling the interactive assembly from the seat support.

Other systems, apparatuses, methods, features, and advantages will be, or will become, apparent to one with skill in the art upon examination of the following figures and detailed description. All such additional systems, apparatuses, methods, features, and advantages are included within this description, are within the scope of the claimed subject matter.

BRIEF DESCRIPTION OF THE DRAWINGS

The infant support structure and steps presented herein may be better understood with reference to the following drawings and description. It should be understood that some elements in the figures may not necessarily be to scale and that emphasis has been placed upon illustrating the principles disclosed herein. In the figures, like-referenced numerals designate corresponding parts/steps throughout the different views.

DETAILED DESCRIPTION OF THE INVENTION

Figure 1A:
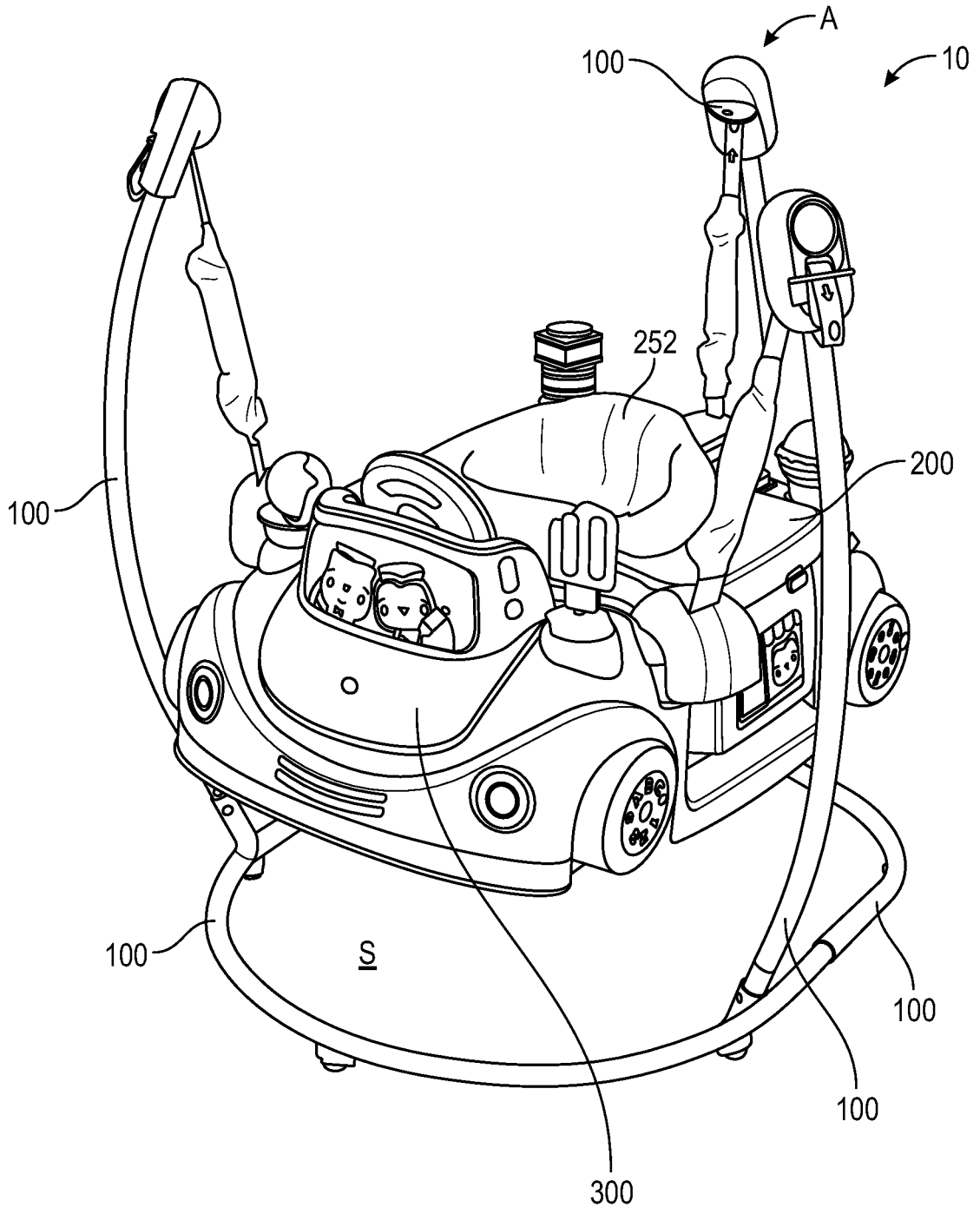
FIG. 1A illustrates a perspective view of an infant support structure in accordance with an example embodiment of the present disclosure.

The present invention is directed toward a reconfigurable infant support structure that is configured to at least facilitate a jumping motion by an infant. The infant support structure may include a frame, a first portion, and a second portion. The first portion may contain a seat configured to receive an infant. The first portion may be movably coupled to the frame via at least one resilient member. The at least one resilient member may be configured to suspend the first portion above a support surface and facilitate movement of the first portion with respect to the frame. The second portion may be removably coupled to the first portion. When coupled to the first portion, the second portion may also be suspended above a support surface, and the infant support structure may provide a first play pattern to the infant. When uncoupled from the first portion, the second portion may be disposed on the support surface while the first portion remains suspended above the support surface. When uncoupled, the second portion may provide a second play pattern where the second portion may surround an infant disposed on the support surface.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the description herein. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

Figure 1B:
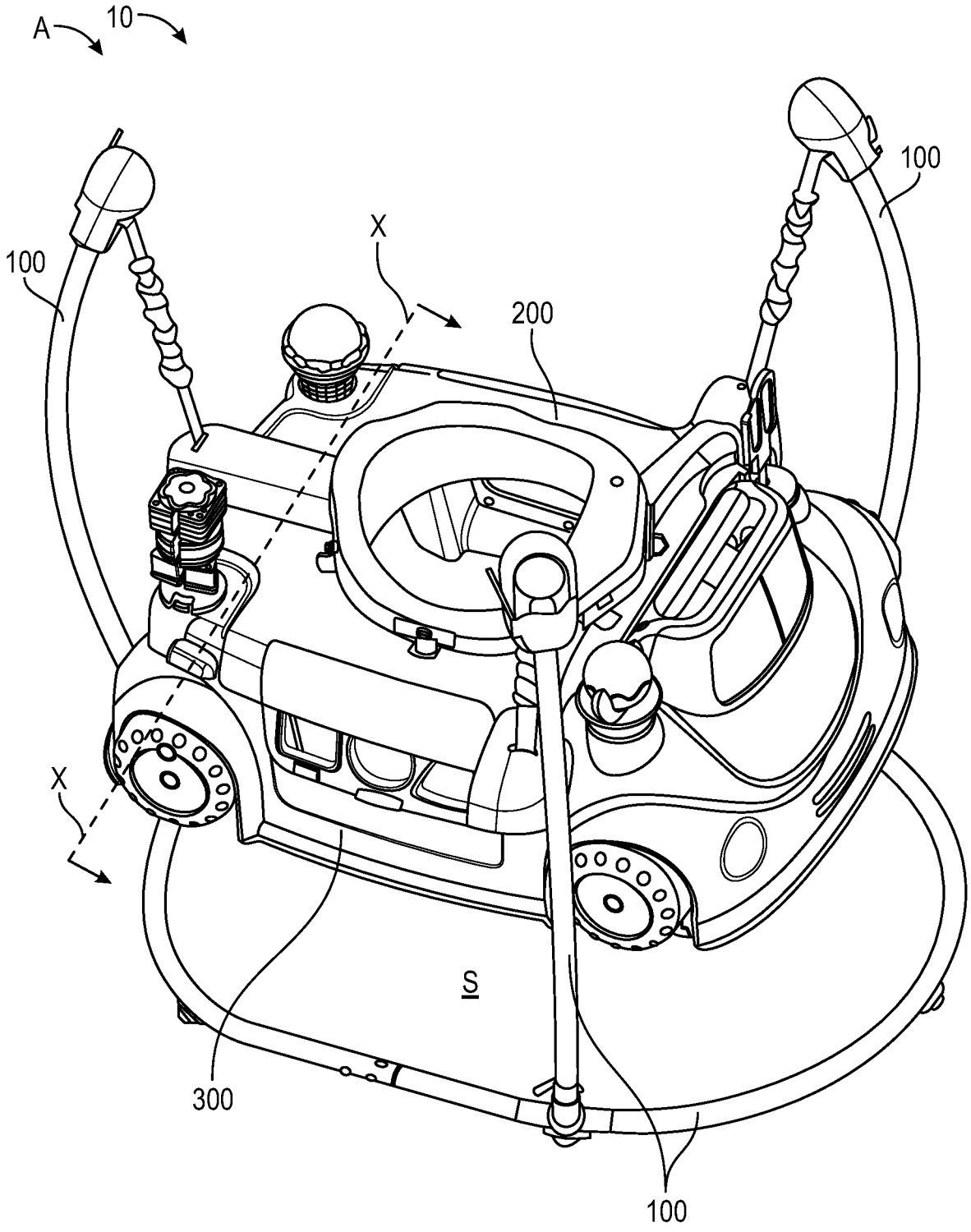
FIG. 1B illustrates a perspective view of the infant support structure illustrated in FIG. 1A in a first configuration.
Figure 1C:
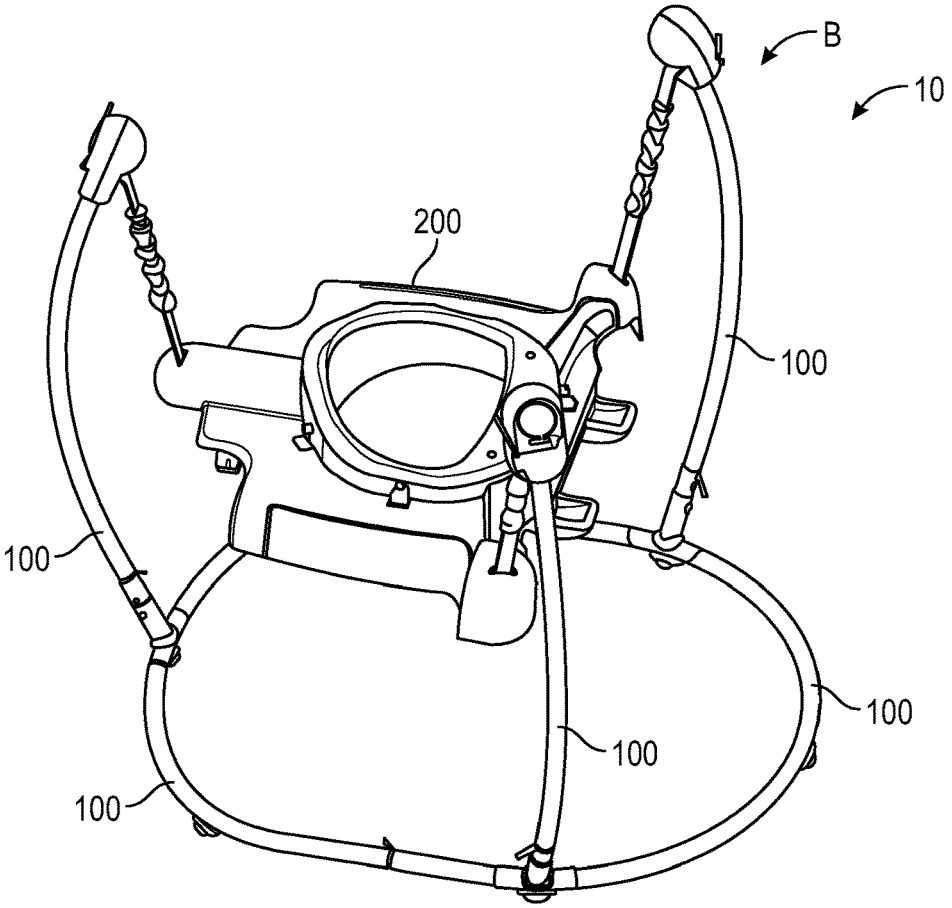
FIG. 1C illustrates a perspective view of the infant support structure illustrated in FIG. 1A in a second configuration.
Figure 1C:
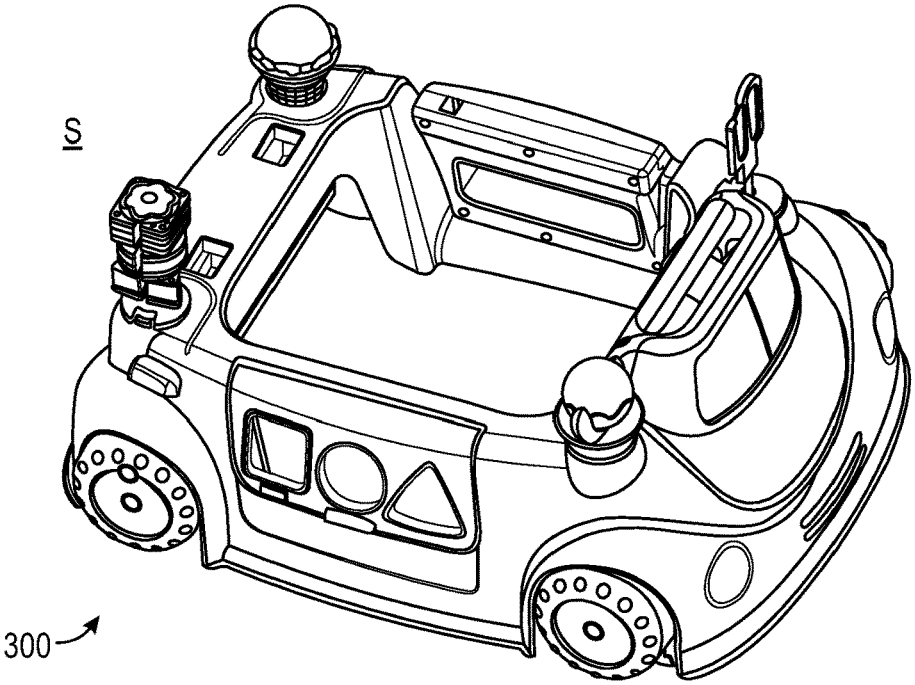

With reference to FIGS. 1A, 1B, and 1C, illustrated are perspective views of an embodiment of an infant support structure 10. The embodiment of the infant support structure 10 illustrated may be an infant jumper that is configured to promote the development of large motor skills (e.g., balance, jumping, leg strength, etc.) for infants. The infant support structure 10 may include a frame portion 100 and a seat support portion 200 coupled to the frame portion 100 such that the seat support portion 200 is suspended above a support surface S. The infant support structure 10 may further include an interactive assembly 300 that is removably coupleable to the seat support portion 200. As explained in further detail below, the embodiment of the infant support structure 10 may be reconfigurable between two configurations based on whether or not the interactive assembly 300 is coupled to the seat support portion 200. In a first configuration A, as illustrated in FIGS. 1A and 1B, the interactive assembly 300 is coupled to the seat support portion 200 such that the interactive assembly 300 is also suspended above a support surface S. In a second configuration B, as illustrated in FIG. 1C, the interactive assembly 300 is uncoupled from the seat support portion 200 such that the interactive assembly 300 is disposed on the support surface S, and the seat support portion 200 remains suspended above the support surface S. The two different configurations promote different play patterns or uses of the infant support structure 10 and the portions 100, 200, 300 thereof. For example, when the infant support structure 10 is in the first configuration A, the infant support structure 10 may promote a first play pattern. One example of a first play pattern includes, but is not limited to, enabling the infant placed in the seat support portion 200 to exercise and jump while interacting with the various interactive components of the interactive assembly 300 that is coupled to the seat support portion 200. When the infant support structure 10 is in the second configuration B, the infant support structure 10 may promote a second play pattern. One example of a second play pattern includes, but is not limited to, enabling the infant to walk/crawl around the interactive assembly 300 to interact with the various interactive components and/or the shape sorting compartment (as explained in further detail below). The second play pattern may also enable, in some examples, the infant to sit within the interactive assembly 300 while they interact with the various interactive components of the interactive assembly 300. Another example of a second play pattern may include, but is not limited to, enabling the infant placed in the seat support portion 200 to exercise and jump without interactive with the toys of the interactive assembly 300 (because the interactive assembly 300 is disconnected from the seat support portion 200).

Figure 2:
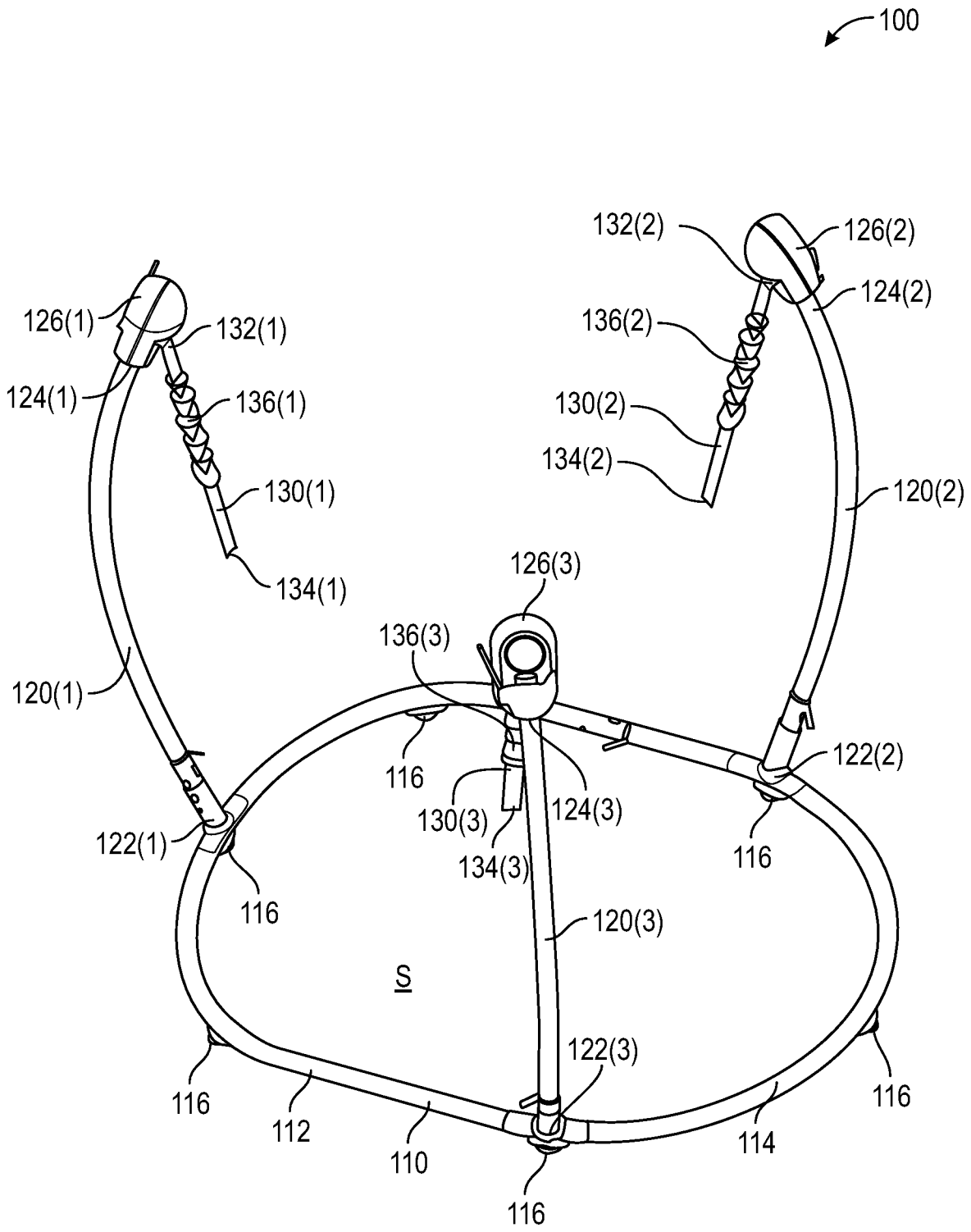
FIG. 2 illustrates a perspective view of the frame portion of the infant support structure illustrated in FIG. 1A, the frame portion being isolated from the other portions of the infant support structure for illustrative purposes only.

Turning to FIG. 2, illustrated is a perspective view of the frame portion 100 of the infant support structure 10 where the frame portion 100 is isolated from the other portions 200, 300 of the infant support structure 10 for illustrative purposes only. The frame portion 100 may include a base portion 110, which, in the embodiment illustrated, is substantially oval or stadium in shape. In other embodiments, the base portion 110 may be in any other shape including, but not limited to, a rectangle, a square, a triangle, etc. In the illustrated embodiment, the base portion 110 of the frame portion 100 includes a first member 112 and a second member 114, where each of the members 112, 114 make up half of the base portion 110. In some further embodiments, the base portion 110 may be a unitary structure constructed from only one member, while in other embodiments, the base portion 110 may be constructed from any number of members. The base portion 110 may further include a series of feet 116 that are configured to engage the support surface S. The feet 116 may be constructed from a resilient and durable material that is configured to grip the support surface to prevent the frame portion 100 from sliding along the support surface S, while also being configured to provide a dampening or suspension-like effect for the frame portion 100 as movements are imparted onto the seat support portion 200, and ultimately the frame portion 100, by the infant disposed in the seat support portion 200.

The frame portion 100 may further include a series of upstanding members 120(1)-120(3) that extend upwardly from the base portion 110. While the embodiment of the frame portion 100 illustrated in FIG. 2 contains three upstanding members 120(1)-120(3), the frame portion 100 may include any number of upstanding members. Each of the upstanding members 120(1)-120(3) contains a proximal end 122(1)-122(3) that are coupled to the base portion 110, and an opposite distal end 124(1)-124(3). The distal ends 124(1)-124(3) of the upstanding members 120(1)-120(3) are spaced above the base portion 110 of the frame portion 100. Coupled to each distal end 124(1)-124(3) of the upstanding members 120(1)-120(3), respectively, are height adjustment mechanisms 126(1)-126(3).

As further illustrated in FIG. 2, coupled to, and hanging from, each of the height adjustment mechanisms 126(1)-126(3) are tethers 130(1)-130(3). More specifically, each tether 130(1)-130(3) contains a proximal end 132(1)-132(3) coupled to their respective height adjustment mechanism 126(1)-126(3) and an opposite distal end 134(1)-134(3). The height adjustment mechanisms 126(1)-126(3) may be any known or later developed mechanism for adjusting the length of the tethers 130(1)-130(3). The length that the tethers 130(1)-130(3) extend from the height adjustment mechanisms 126(1)-126(3) determines the height above the support surface S that the seat support portion 200 and, depending on the configuration, the interactive assembly 300 are suspended. The tethers 130(1)-130(3) may be constructed from a resilient material including, but not limited to, linear springs, rubber tethers, elastic woven tethers/belts, etc. The tethers 130(1)-130(3) may be further equipped with coverings 136(1)-136(3) that are configured to protect the tethers 130(1)-130(3) from being impacted by objects that may affect their integrity, while also being configured to prevent infants from trapping their extremities (e.g., fingers, hands, arms, etc.) in the tethers 130(1)-130(3).

Figure 3A:
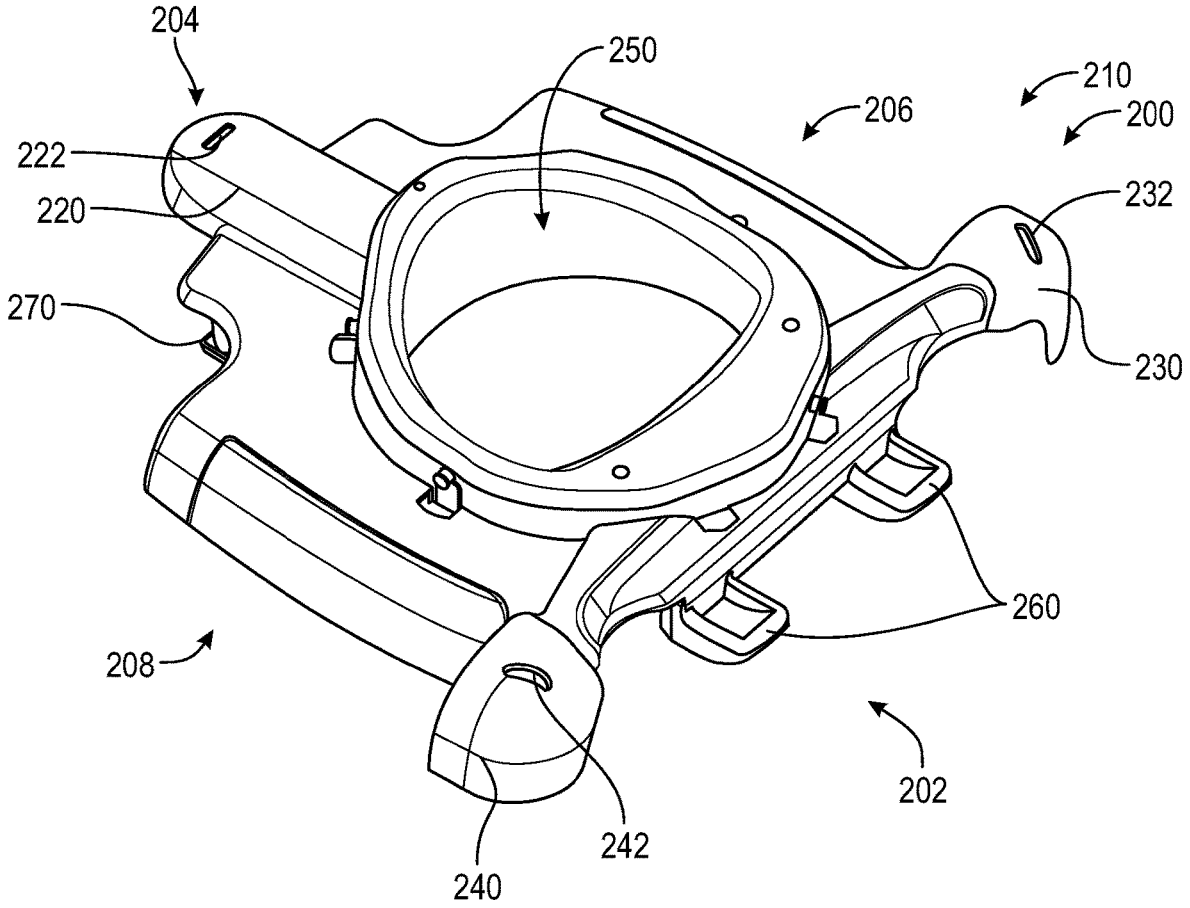
FIG. 3A illustrates a top perspective view of the seat support portion of the infant support structure illustrated in FIG. 1A, the seat support portion being isolated from the other portions of the infant support structure for illustrative purposes only.
Figure 3B:
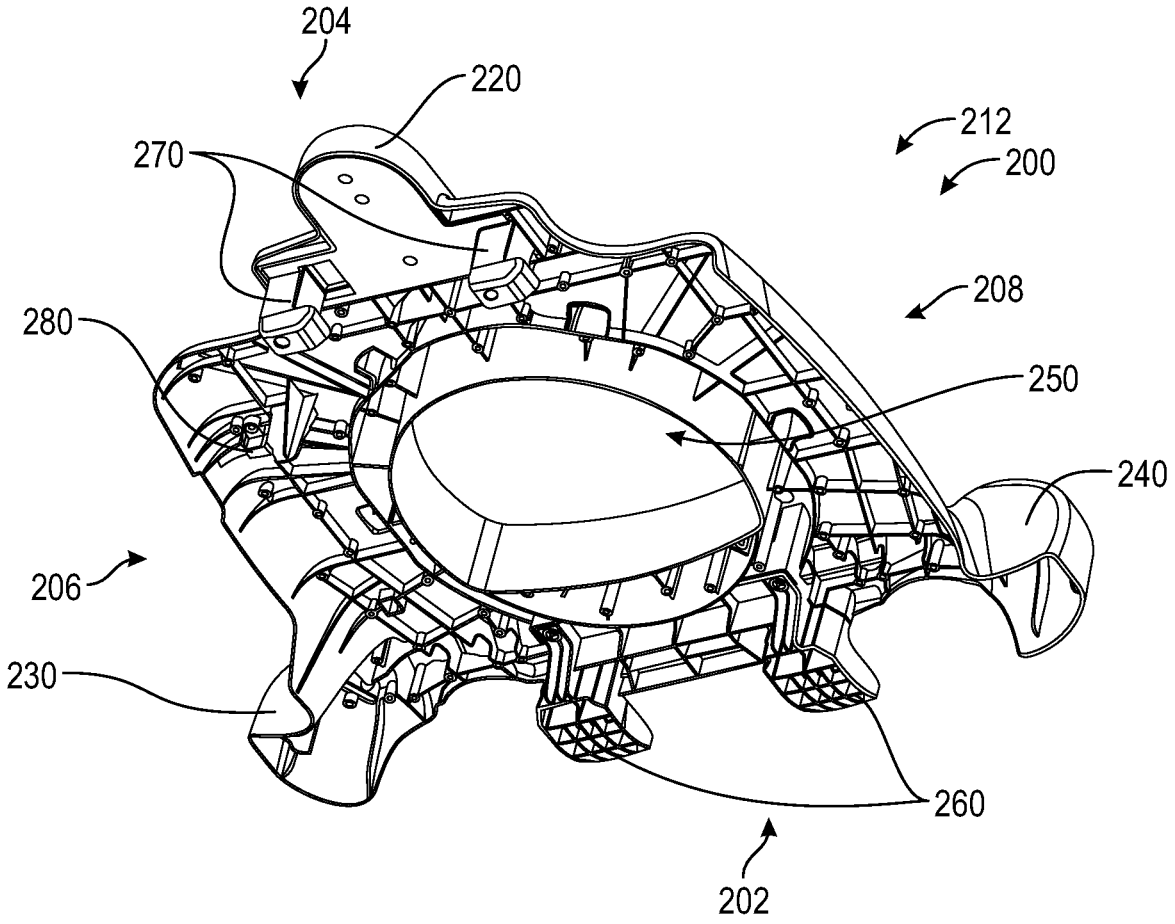
FIG. 3B illustrates a bottom perspective view of the seat support portion illustrated in FIG. 3A.

Turning to FIGS. 3A and 3B, illustrated are perspective views of the seat support portion 200 of the infant support structure 10 where the seat support portion 200 is isolated from the other portions 100, 300 of the infant support structure 10 for illustrative purposes only. The seat support portion 200 includes a front side 202, an opposite rear side 204, a first side 206 extending from the front side 202 to the rear side 204, an a second side opposite the first side 206 that also extends from the front side 202 to the rear side 204. The seat support portion 200 may further include a top side 210 and an opposite bottom side 212. In the embodiment illustrated, the seat support portion 200 may include a rear side extension 220 that generally extends horizontally from the rear side 204 of the seat support portion 200. The rear side extension 220 may contain a coupling location 222 for coupling the seat support portion 200 to the frame portion 100. The seat support portion 200 may further include a first side extension 230 and a second side extension 240. The first side extension 230 may generally extend horizontally from the first side 206 of the seat support portion 200 proximate to the front side 202, while the second side extension 240 may generally extend horizontally from the second side 208 of the seat support portion 200 proximate to the front side 202. Like the rear side extension 220, the first side extension 230 may contain a coupling location 232, while the second side extension 240 may also contain a coupling location 242. Like that of the coupling location 222 of the rear side extension 220, the coupling locations 232, 242 of the first and second side extensions 230, 240, respectively, are configured to couple the seat support portion 200 to the frame portion 100.

Continuing with FIGS. 3A and 3B, the seat support portion 200 further includes a central opening 250 that extends through the seat support portion 200 from the top side 210 to the bottom side 212. As best illustrated in FIGS. 1A and 4B, the central opening 250 may be configured to receive a fabric seat 252 that is configured to receive and retain an infant. Coupled to the bottom side 212 of the seat support portion 200 and extending from the front side 202 of the seat support portion 200 is a pair of front engagement arms 260. Also coupled to the bottom side 212 of the seat support portion 200, but extending downwardly from the bottom side 212 proximate to the rear side 204 and the rear side extension 220 of the seat support portion 200 are latch engagement members 270. As best illustrated in FIG. 3B, the seat support portion 200 may also include a door alignment member 280 coupled to the bottom side 212 of the seat support portion 200 proximate to the first side 206 of the seat support portion 200.

Figure 4A:
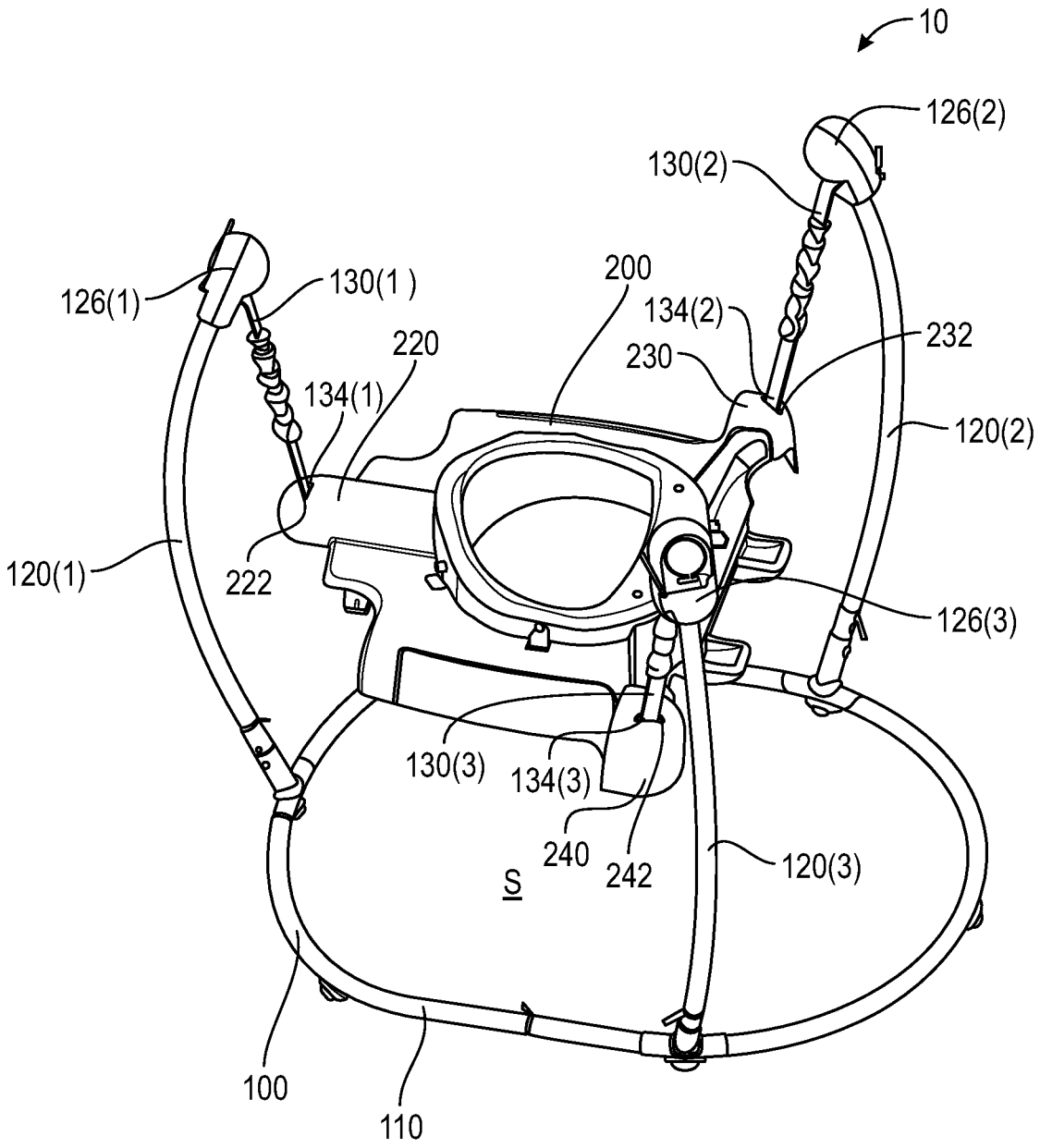
FIG. 4A illustrates a perspective view of the seat support portion illustrated in FIG. 3A coupled to the frame portion illustrated in FIG. 2A.
Figure 4B:
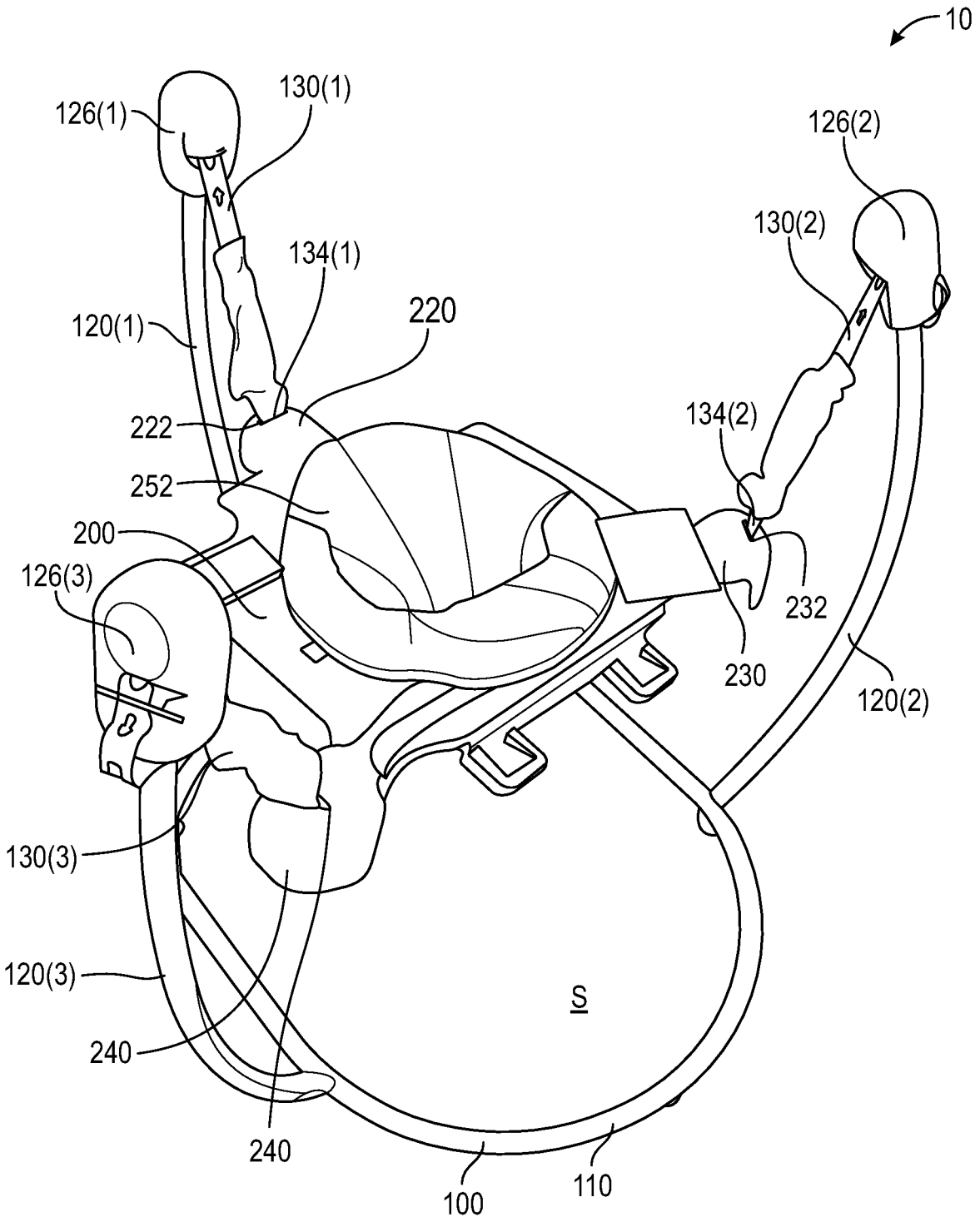
FIG. 4B illustrates another perspective view of the seat support portion illustrated in FIG. 3A coupled to the frame portion illustrated in FIG. 2A where the fabric seat member is coupled to the central opening of the seat support portion.

Turning to FIGS. 4A and 4B, illustrated is a perspective view of the seat support portion 200 coupled to the frame portion 100 such that the seat support portion 200 is suspended above the support surface S. As illustrated in FIGS. 4A and 4B, the rear side extension 220 of the seat support portion 200 is coupled to the first upstanding member 120(1) of the frame portion 100. More specifically, the first tether 130(1), which is coupled to the first height adjustment mechanism 126(1) of the first upstanding member 120(1) of the frame portion 100, is coupled to the coupling location 222 of the rear side extension 220 of the seat support portion 200 at the distal end 134(1) of the first tether 130(1). In addition, the first side extension 230 of the seat support portion 200 is coupled to the second upstanding member 120(2) of the frame portion 100. As illustrated, the second tether 130(2), which is coupled to the second height adjustment mechanism 126(2) of the second upstanding member 120(2) of the frame portion 100, is coupled to the coupling location 232 of the first side extension 230 of the seat support portion 200 at the distal end 134(2) of the second tether 130(2). As further illustrated, the second side extension 240 of the seat support portion 200 is coupled to the third upstanding member 120(3) of the frame portion 100. More specifically, the third tether 130(3), which is coupled to the third height adjustment mechanism 126(3) of the third upstanding member 120(3) of the frame portion 100, is coupled to the coupling location 242 of the second side extension 240 of the seat support portion 200 at the distal end 134(3) of the third tether 130(3).

Figure 5A:
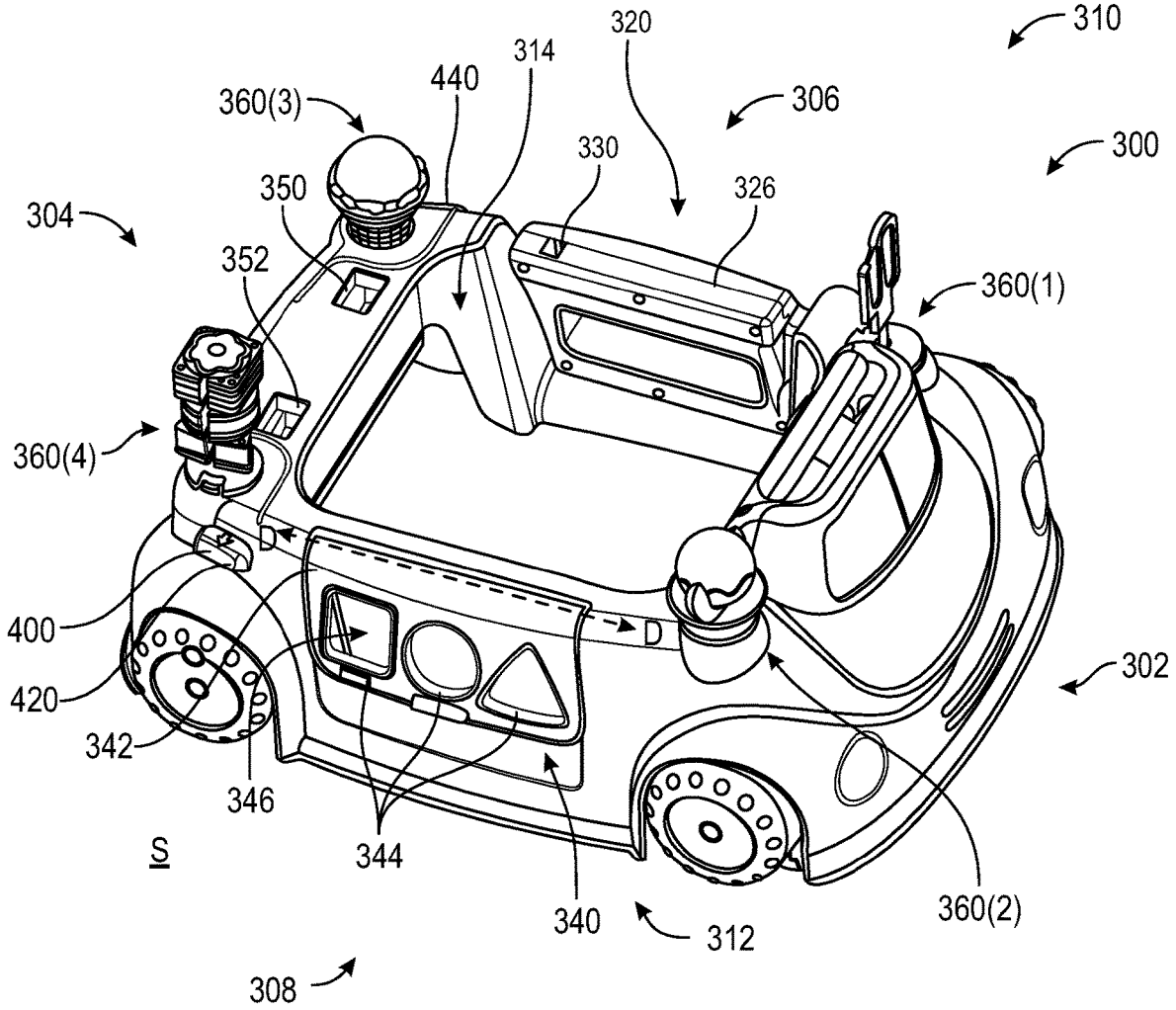
FIG. 5A illustrates a perspective view of the interactive assembly of the infant support structure illustrated in FIG. 1A, the interactive assembly being isolated or uncoupled from the other portions of the infant support structure.
Figure 5B:
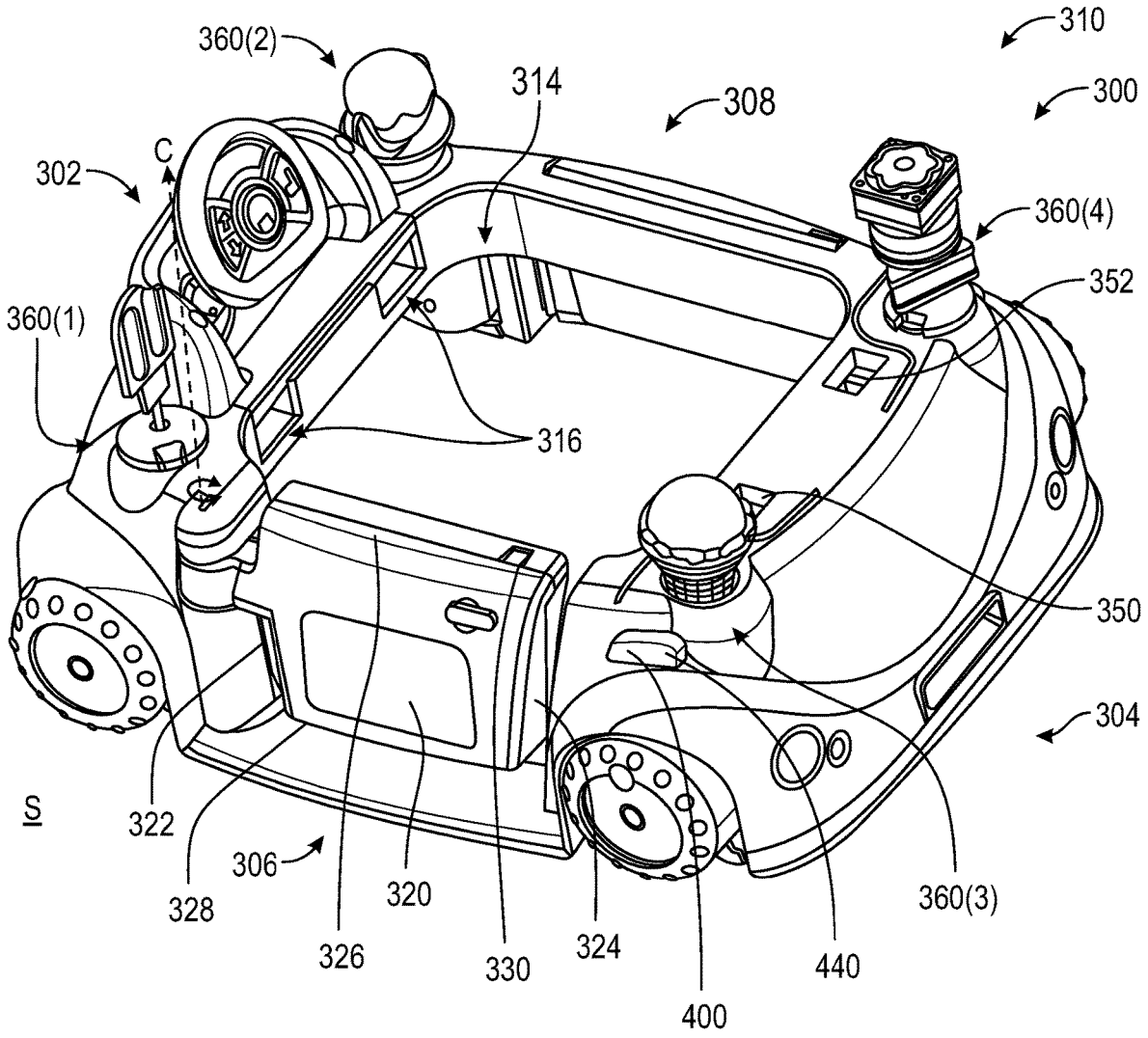
FIG. 5B illustrates another perspective view of the interactive assembly illustrated in FIG. 5A.

Turning to FIGS. 5A and 5B, illustrated are perspective views of the interactive assembly 300 of the infant support structure 10 uncoupled from the seat support portion 200 and disposed on a support surface S. The embodiment of the interactive assembly 300 illustrated in FIGS. 5A and 5B represents a vehicle. However, in other embodiments, the interactive assembly 300 may resemble any other type of vehicle, structure, animal, item, etc. The interactive assembly 300 includes a front side 302, an opposite rear side 304, a first side 306 spanning from the front side 302 to the rear side 304, and a second side 308 opposite the first side 306 that also spans from the front side 302 to the rear side 304. The interactive assembly 300 also includes a top side 310 and an opposite bottom side 312. The front side 302, rear side 304, first side 306, and second side 308 collectively define a central cavity 314. The top side 310 and the bottom side 312 may be open to the central cavity 314. The central cavity 314 may be sized to receive an infant (i.e., such that an infant may be located within the central cavity 314) when the interactive assembly 300 is disposed on the support surface S when the infant support structure is in the second configuration B. As best illustrated in FIG. 5B, the central cavity 314 may include a pair of front attachment openings 316 that are disposed within the central cavity 314 and proximate to the front side 302 of the interactive assembly 300. As explained in further detail below, the front attachment openings 316 may be sized, shaped, and spaced from one another such that they are configured to receive the front engagement arms 260 of the seat support portion 200 when coupling the interactive assembly 300 to the seat support portion 200.

As further illustrated in FIGS. 5A and 5B, the interactive assembly 300 contains a reconfigurable door panel 320 that is rotatably disposed on the first side 306 of the interactive assembly 300. The door panel 320 may include a first end 322, an opposite second end 324, a top edge 326 spanning from the first end 322 to the second end 324, and a bottom edge 328 that is opposite the top edge 326 and that also spans from the first end 322 to the second end 324. The door panel 320 may be rotatably coupled to the first side 306 of the interactive assembly 300 at the first end 322 of the door panel 320 such that the door panel 320 is configured to rotate about vertical axis C between a closed position, like that illustrated in FIGS. 5A and 5B where the door panel 320 is located within the same plane as the first side 306 of the interactive assembly 300, and an open position, like that illustrated in FIG. 6, where the door panel 320 is not entirely located within the same plane as the first side 306 of the interactive assembly 300. The door panel 320 further includes an alignment opening 330 disposed within the top edge 326 proximate to the second end 324. The alignment opening 330 may be configured to receive the door alignment member 280 of the seat support portion 200 when the interactive assembly 300 is coupled to the bottom side 212 of the seat support portion 200.

As best illustrated in FIG. 5A, the interactive assembly 300 may further include a shape sorting compartment 340 disposed on the second side 308 of the interactive assembly 300. The shape sorting compartment 340 of the interactive assembly 300 may include a shape sorting door 342 that is rotatably coupled to the second side 308 of the interactive assembly 300 such that the shape sorting door 342 rotates about substantially horizontal axis D. The shape sorting door 342 may include a series of openings 344, each of which being a different shape (e.g., square, circle, triangle). The shape sorting door 342 may also provide access to an interstitial space 346 within the second side 308 of the interactive assembly 300, either through the series of openings 344 or by rotating the shape sorting door 342 about axis D to an open position (not shown).

As further illustrated in FIGS. 5A and 5B, the interactive assembly 300 may further include a first latch opening 350 and a second latch opening 352. The first latch opening 350 may be disposed on the top side 310 of the interactive assembly 300 proximate to the rear side 304 and the first side 306 of the interactive assembly 300. The second latch opening 352 may be disposed on the top side 310 of the interactive assembly 300 proximate to the rear side 304 and the second side 308 of the interactive assembly 300. As explained in further detail below, the first and second latch openings 350, 352 may be configured to receive the latch engagement members 270 of the seat support portion 200.

The interactive assembly 300 may further include any number of interactive components 360(1)-360(N). The embodiment of the interactive assembly 300 illustrated in FIGS. 5A and 5B contains four interactive components 360(1)-360(4) that are coupled to the top side 310 of the interactive assembly 300 at various locations. In other embodiments, the interactive assembly 300 may contain any number of interactive components, which may be fixedly secured or removably coupled to the interactive assembly 300 at any location.

Figure 6:
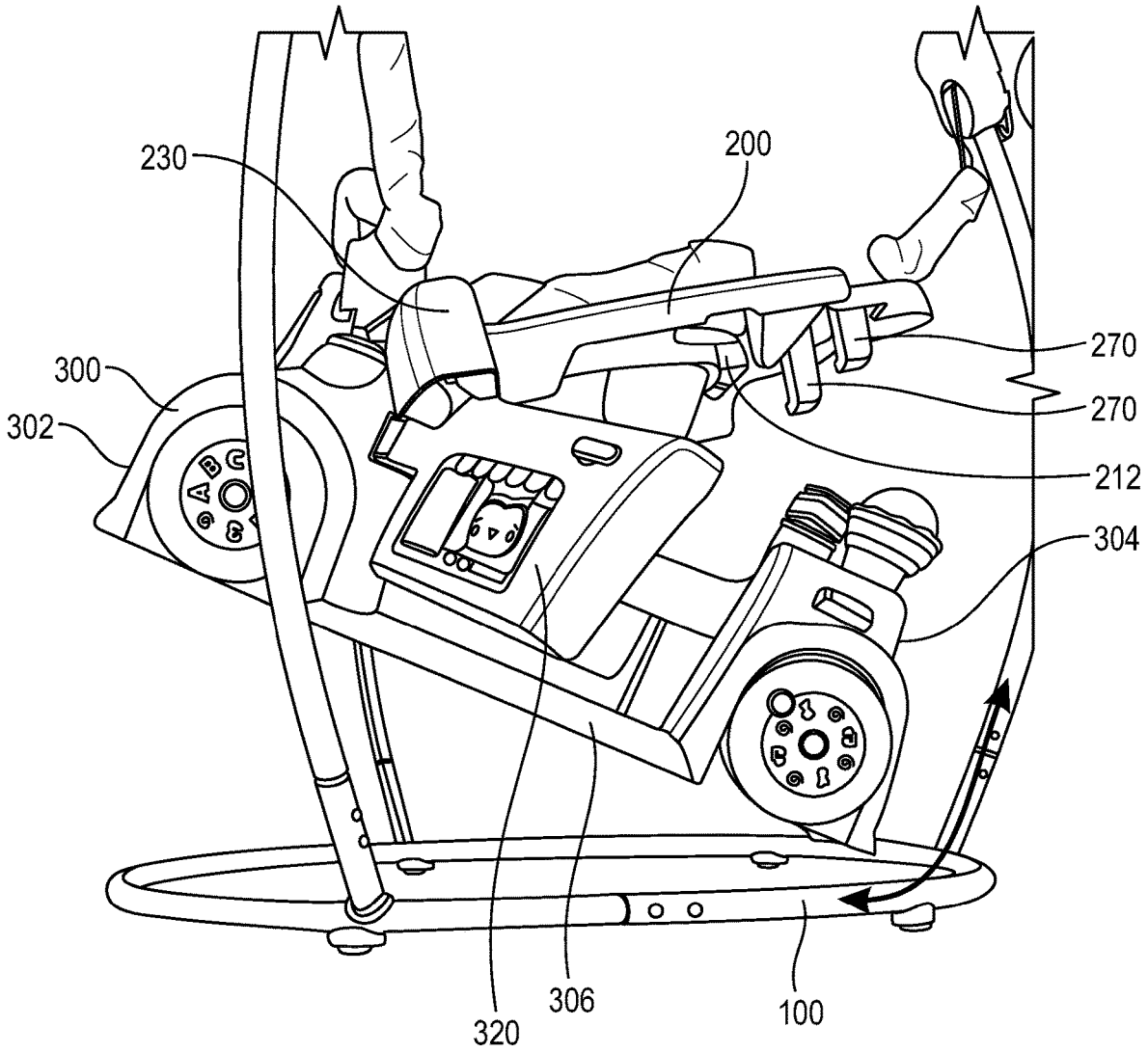
FIG. 6 illustrates a side view of the infant support structure illustrated in FIG. 1A where the interactive assembly is partially coupled to the seat support portion.

As best illustrated in FIG. 6, in order to couple the interactive assembly 300 to the bottom side 212 of the seat support portion 200, the front engagement arms 260 may be inserted into the front attachment openings 316 of the cavity 314 of the interactive assembly 300. The rear side 304 may then be rotated upward toward the bottom side 212 of the seat support portion 200 until the latch engagement members 270 are inserted into, or received by, the first and second latch openings 350, 352. However, as further illustrated in FIG. 6, when the door panel 320 is rotated to the open position, the geometry of the door panel 320 extending from the first side 306 of the interactive assembly 300 coupled with the geometry of the first side extension 230 of the first side 206 of the seat support portion 200 prevents the rear side 304 of the interactive assembly 300 from being rotated upward so that the first and second latch openings 350, 352 receive the latch engagement members 270. Thus, the geometry of the seat support portion 200 and the geometry of the interactive assembly 300 prevent the interactive assembly 300 from being coupled to the bottom side 212 of the seat support portion 200 when the door panel 320 of the interactive assembly 300 is in the opened position.

Figure 7:
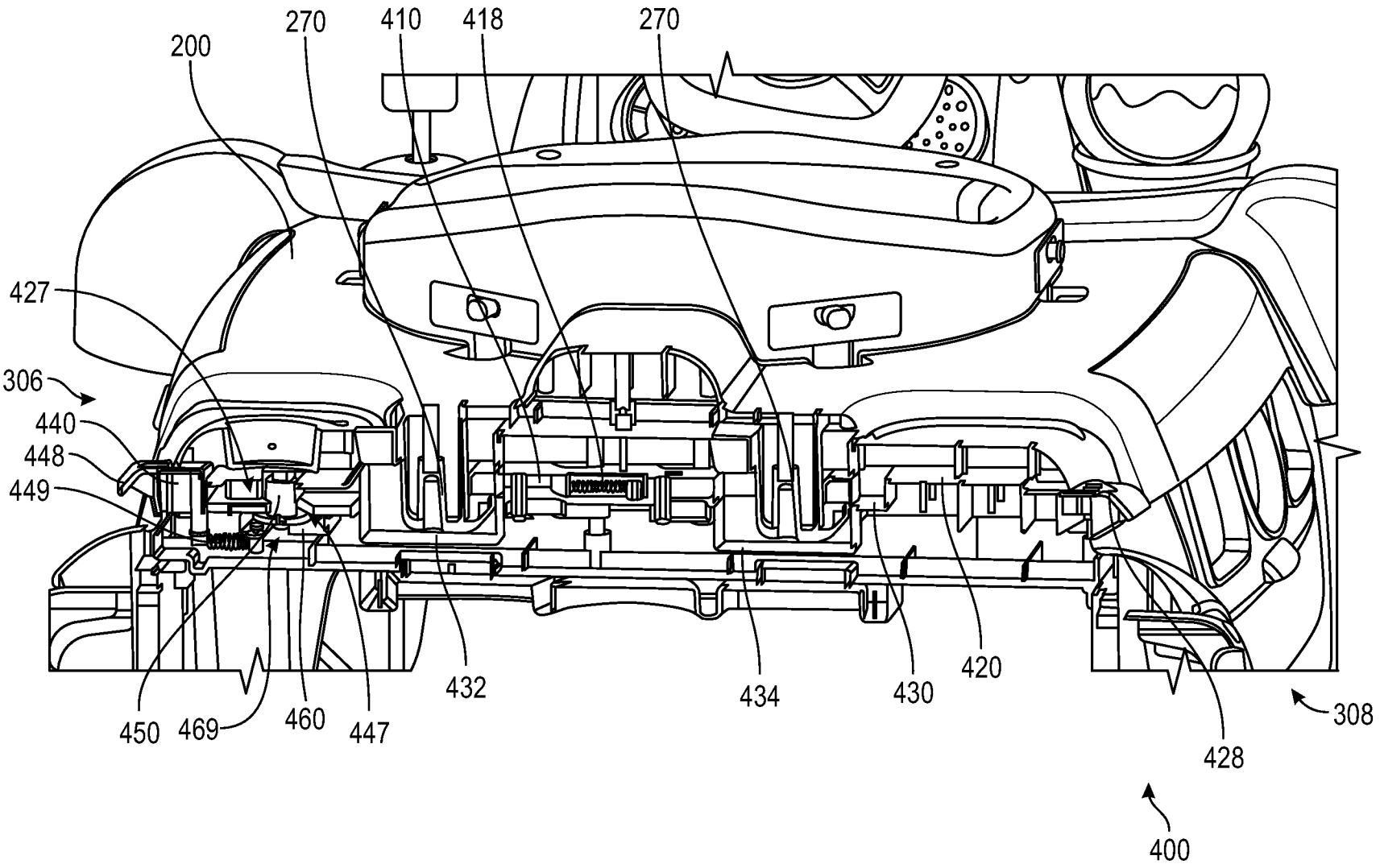
FIG. 7 illustrates a cross-sectional view of the infant support structure of FIG. 1B taken along line X-X, which displays the latch mechanism of the interactive assembly.
Figure 8:
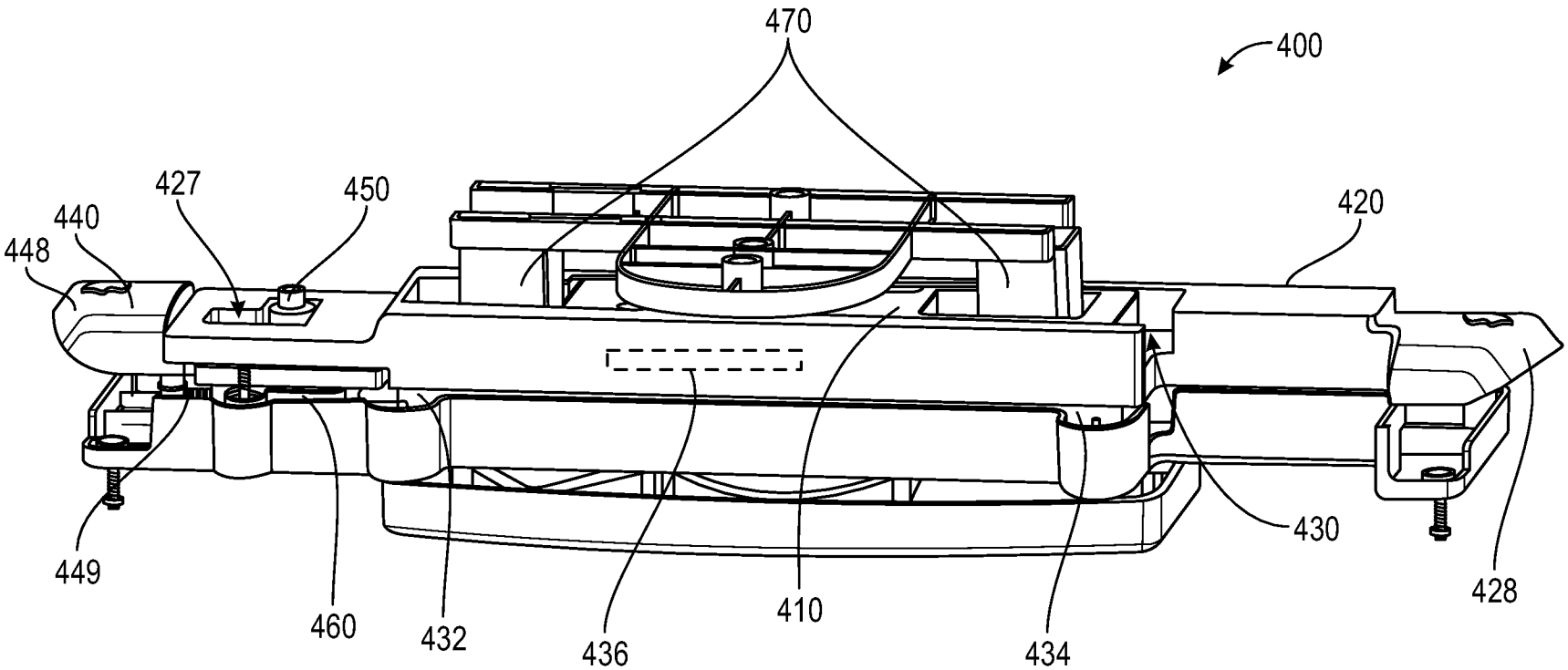
FIG. 8 illustrates an side view of the latch mechanism of the interactive assembly illustrated in FIG. 5A and the engagement members of the seat support portion illustrated in FIG. 3A, where the latch mechanism and engagement members are isolated for illustrative purposes only.

Turning to FIGS. 7 and 8, and with continued reference to FIGS. 5A and 5B, the interactive assembly 300 further includes a latch mechanism 400 that facilitates the removable coupling of the interactive assembly 300 to the seat support portion 200. The embodiment of the latch mechanism 400 illustrated in FIGS. 7 and 8 includes a latching member 410, a first actuation member 420, a second actuation member 440, a sliding pin 450, and a base member 460. As illustrated in the cross-sectional view of FIG. 7, and further illustrated in FIGS. 5A and 5B, the latch mechanism 400 is disposed within the interactive assembly 300 proximate to the rear side 304 and the first and second latch openings 350, 352. As further illustrated, the first actuation member 420 at least partially extends out of the second side 308 of the interactive assembly 300, while the second actuation member 440 at least partially extends out of the first side 306 of the interactive assembly 300. As explained in further detail below, and as illustrated in FIGS. 7 and 8, the latch mechanism 400 is configured to receive and latch onto the latch engagement members 270 of the seat support portion 200. The latch mechanism 400 is further configured to disengage from the latch engagement members 270 of the seat support portion 200 (i.e., to facilitate the uncoupling of the interactive assembly 300 from the seat support portion 200) via a simultaneous actuation of both the first actuation member 420 and the second actuation member 440 (i.e., via a double actuation). In other words, actuation of only one of the first actuation member 420 or the second actuation member 440 does not release the interactive assembly 300 from the seat support portion 200 (i.e., actuation of one of the first actuation member 420 or the second actuation member 440 does not disengage the latch engagement members 270 from the latch mechanism 400).

Figure 9:
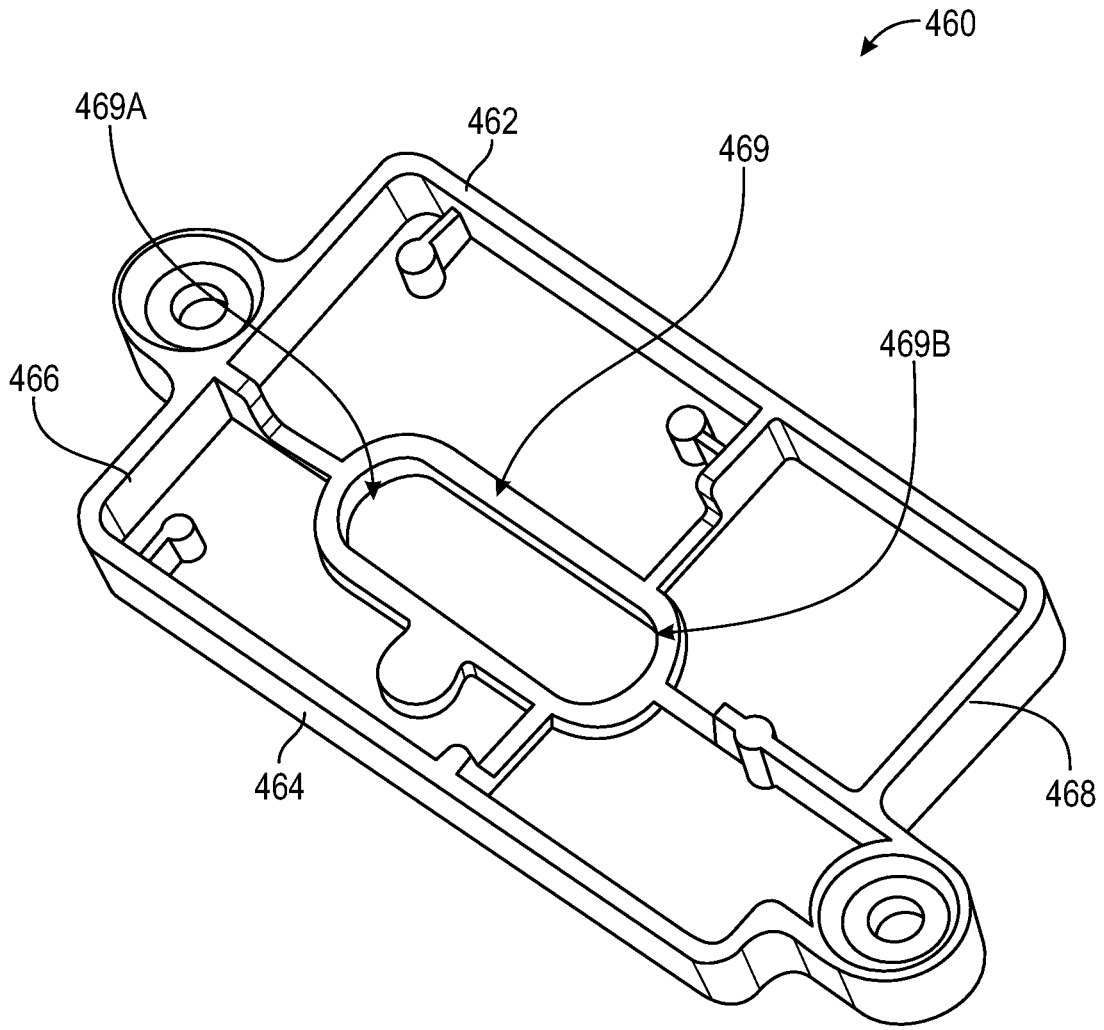
FIG. 9 illustrates a perspective view of the base member of the latch mechanism illustrated in FIG. 8.
Figure 10A:
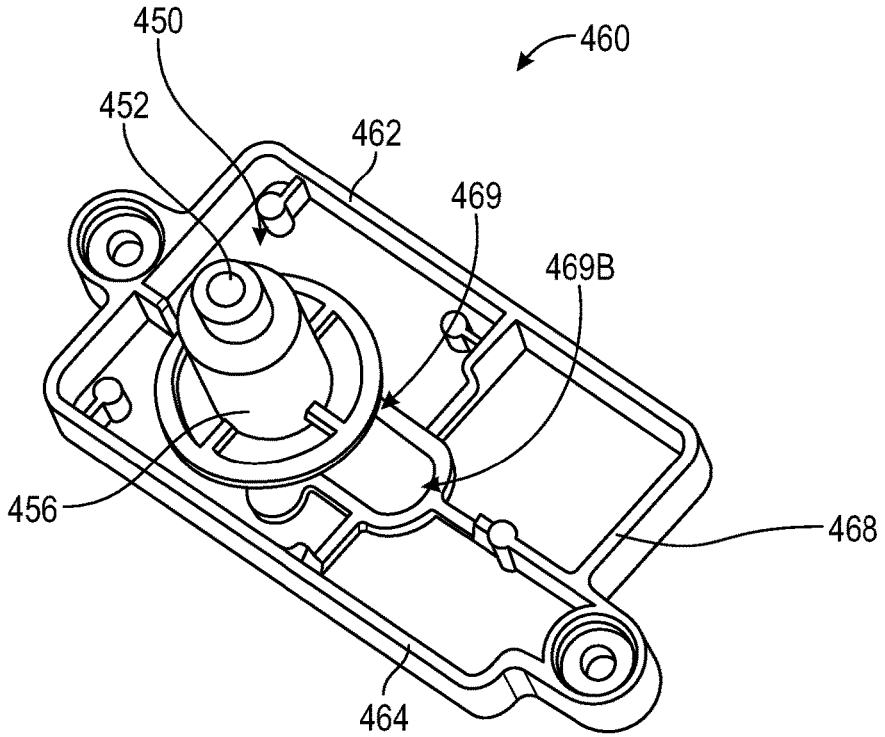
FIG. 10A illustrates a top perspective view of the sliding pin movably coupled to the base member illustrated in FIG. 9.
Figure 10B:
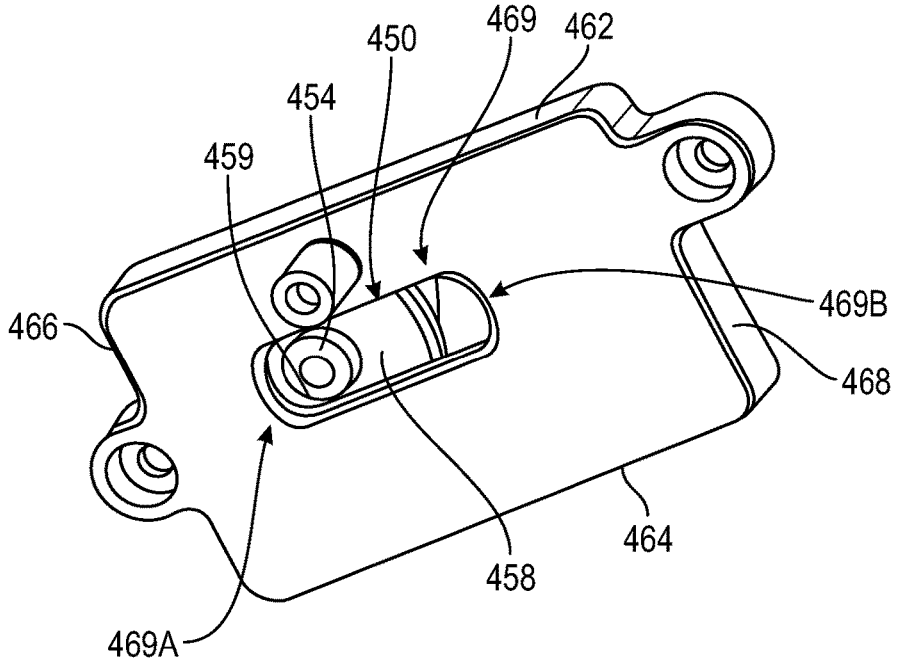
FIG. 10B illustrates a bottom perspective view of the sliding pin movably coupled to the base member illustrated in FIG. 9.

Turning to FIGS. 9, 10A, and 10B, and with continued reference to FIGS. 5A, 5B, 7, and 8, the base member 460 may be substantially planar, and may include a first end 462, an opposite second end 464, a first side 466 spanning from the first end to the second end 464, and a second side 468 opposite the first side 466 and also spanning from the first end to the second end 464. As further illustrated, the base member 460 may include a linear slot 469 that extends along the base member 460 in a direction that spans between the first side 466 to the second side 468, where the linear slot 469 has a first end 469A and a second end 469B. As best illustrated in FIGS. 7 and 8, the base member 460 of the latch mechanism 400 may be disposed within the interactive assembly 300 more proximate to the first side 306 of the interactive assembly 300 than to the second side 308 of the interactive assembly 300.

Continuing with FIGS. 10A and 10B, the latch mechanism 400 may further include a sliding pin 450. The sliding pin 450 may be substantially cylindrical with a first end 452 and a second end 454. The sliding pin 450 may further include a sidewall 456 extending from the first end 452 to the second end 454. Extending outwardly from the sidewall 456 more proximate to the second end 454 than the first end 452 is a flange 458. Formed on one side of the flange proximate to the second end 454 of the sliding pin 450 is a protrusion 459. As best illustrated in FIG. 10B, the protrusion 459 may be received within the linear slot 469 of the base member 460, which facilitates or enables the sliding pin 450 to slide along the linear slot 469 of the base member 460 between the first end 469A of the linear slot 469 and the second end 469B of the linear slot 469.

Figure 11A:
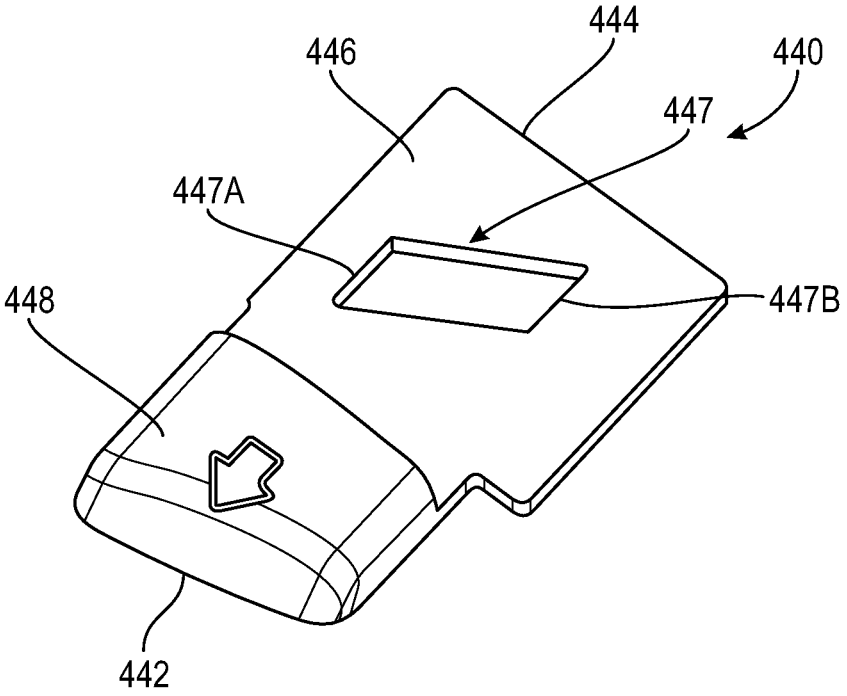
FIG. 11A illustrates a perspective view of the second actuation member of the latch mechanism illustrated in FIG. 8.
Figure 11B:
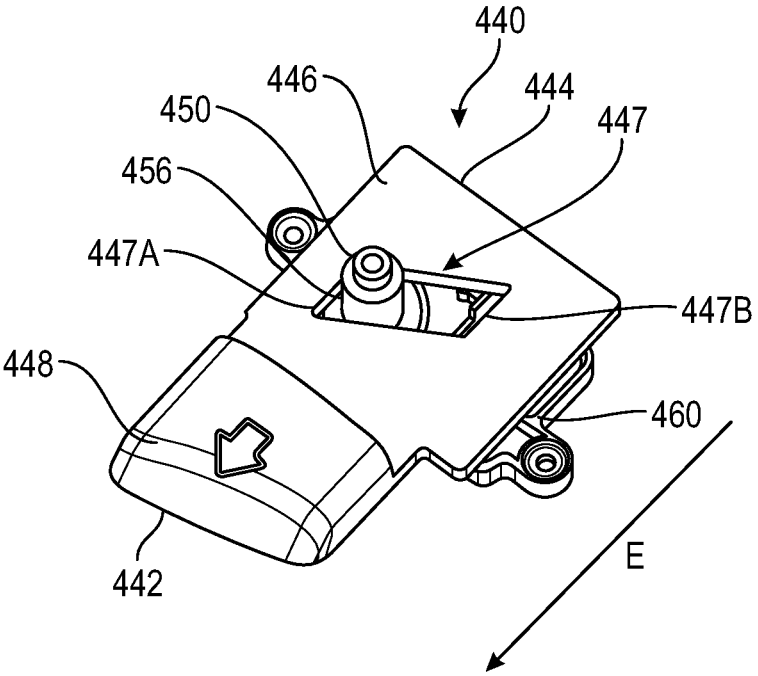
FIG. 11B illustrates a perspective view of the second actuation member illustrated in FIG. 11A movably coupled to the sliding pin and base member illustrated in FIG. 10A.

Turning to FIGS. 11A and 11B, and with continued reference to FIGS. 5A, 5B, 7-9, 10A, and 10B, illustrated is the second actuation member 440. As best illustrated in FIG. 11A, the second actuation member 440 may include a first end 442 and an opposite second end 444. The portion of the second actuation member 440 proximate to the second end 444 may be in the form of a planar platform 446 that contains a slanted or angled slot 447 having a first end 447A and a second end 447B (i.e., the second end 447B may be disposed more proximate to the second end 444 than the first end 447A). In addition, the first end 442 of the second actuation member 440 may be formed as a handle 448 configured to be grabbed or engaged by a user's hand. As best illustrated in FIGS. 5A, 5B, and 7, the handle 448 of the second actuation member 440 may extend outwardly from the first side 306 of the interactive assembly 300. Moreover, as best illustrated in FIG. 11B, the second actuation member 440 may be disposed on top or above the base member 460, where the slanted slot 447 at least partially receives the sliding pin 450 (i.e., such that the slanted slot 447 engages the sidewall 456 of the sliding pin 450 and the flange 458 is disposed between the second actuation member 440 and the base member 460). The second actuation member 440 may further include a biasing member (e.g., a spring) 449, which is best illustrated in FIGS. 7 and 8, that bias the second actuation member 440 to the unactuated position (i.e., such that the sliding pin 450 is disposed proximate to the first end 447A of the slanted slot 447). As explained in further detail below, when the second actuation member 440 is actuated or pulled out from the interactive assembly 300 (along direction E), the slant or angle of the slanted slot 447 causes the sliding pin 450 to slide from the first end 447A to the second end 447B. When this happens, the sliding pin 405 also simultaneously slides along the linear slot 469 of the base member 460 from the first end 469A to the second end 469B of the linear slot 469.

Figure 12A:
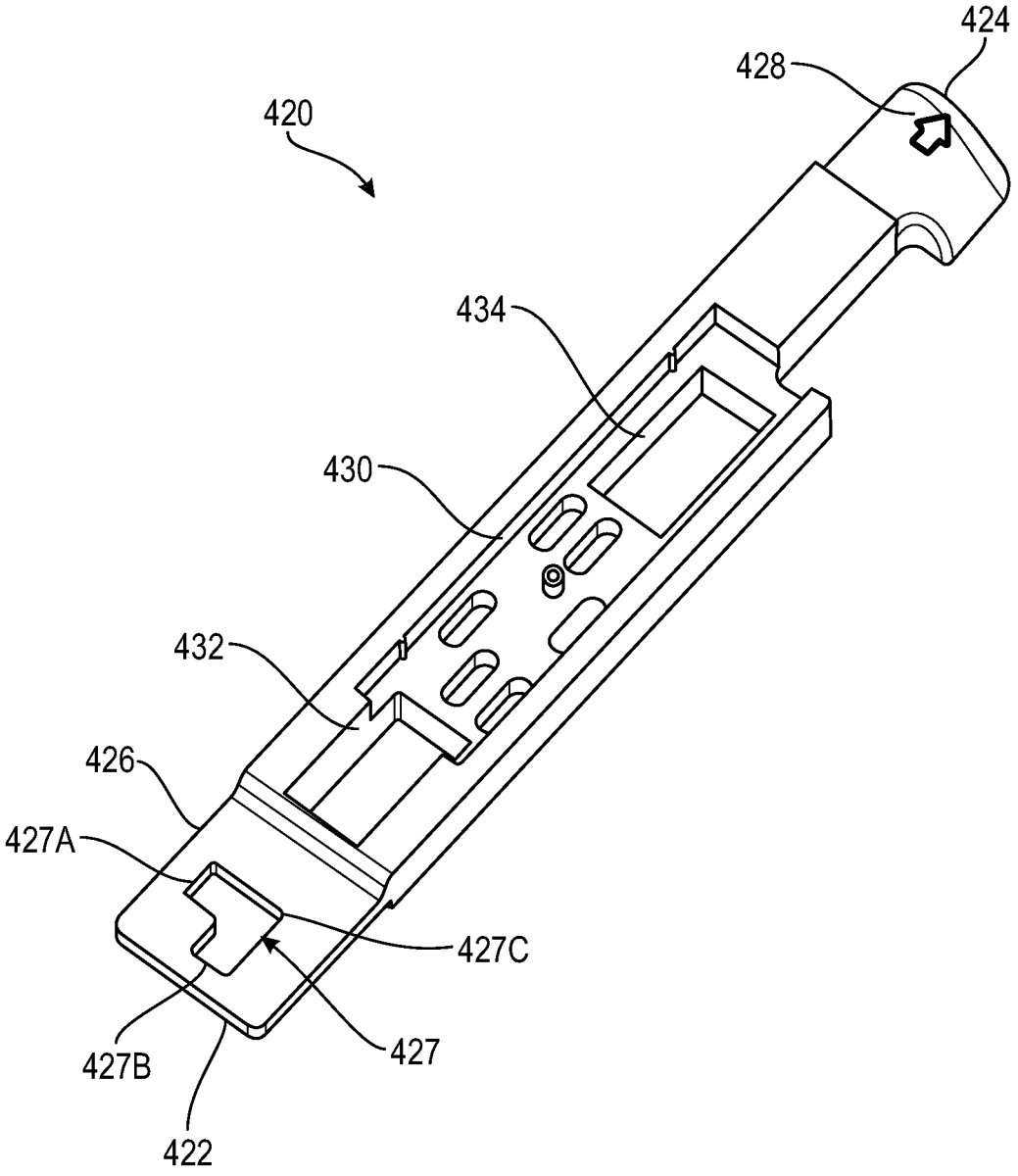
FIG. 12A illustrates a perspective view of the first actuation member of the latch mechanism illustrated in FIG. 8.
Figure 12B:
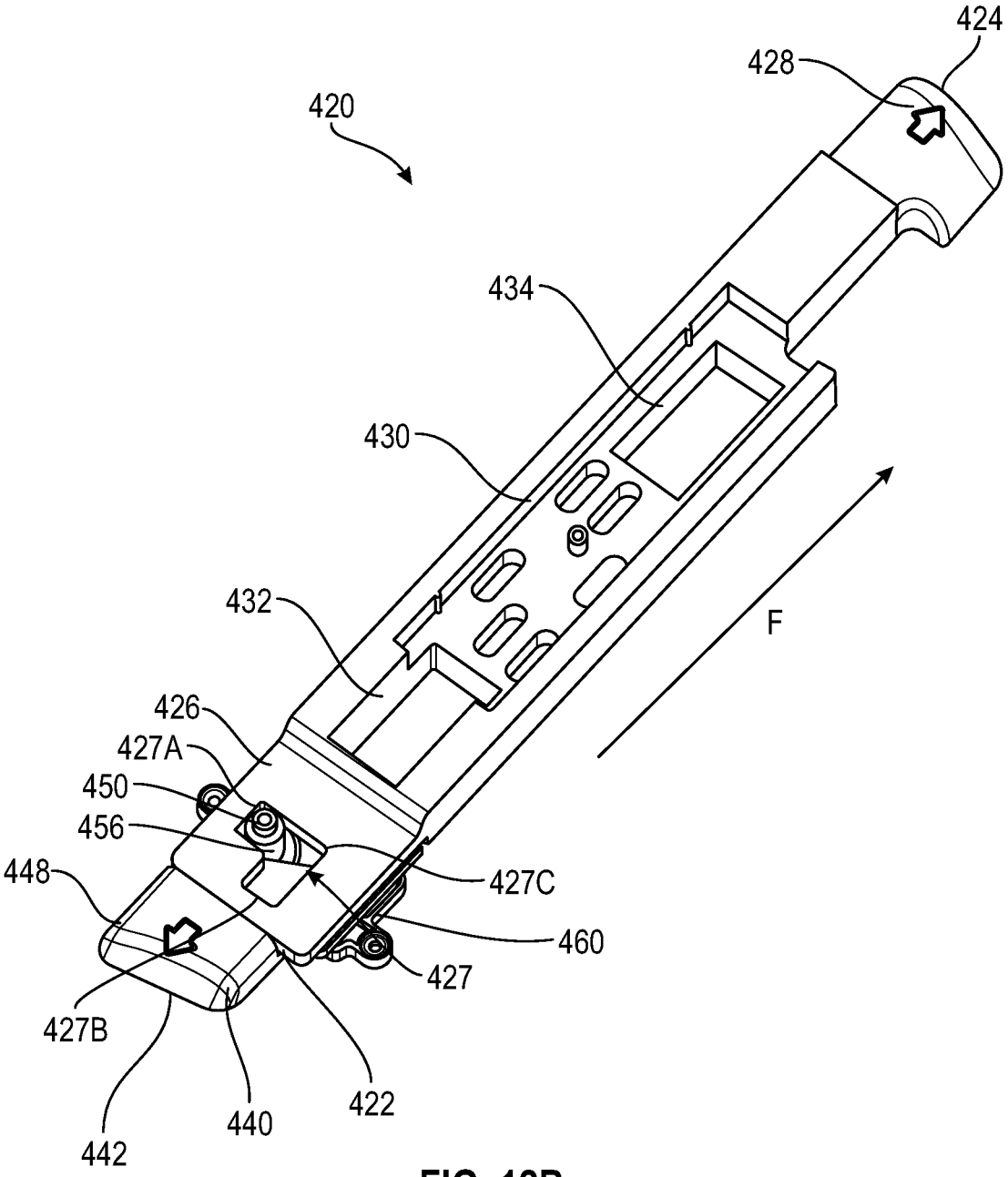
FIG. 12B illustrates a perspective view of the first actuation member illustrated in FIG. 12A movably coupled to the second actuation member, sliding pin, and base member illustrated in FIG. 11B.

Turning to FIGS. 12A and 12B, and with continued reference to FIGS. 5A, 5B, 7-9, 10A, 10B, 11A, and 11B, illustrated is the first actuation member 420. As illustrated, the first actuation member 420 may be an elongated member with a first end 422 and an opposite second end 424. The portion of the first actuation member 420 proximate to the first end 422 may be in the form of a planar platform 426 that contains an L-shaped slot 427 having a first end 427A, a second end 427B, and an intermediate corner 427C. In addition, the second end 424 of the first actuation member 420 may be formed as a handle 428 configured to be grabbed or engaged by a user's hand. As best illustrated in FIGS. 5A, 5B, and 7, the handle 428 of the first actuation member 420 may extend outwardly from the second side 308 of the interactive assembly 300.

The first actuation member 420 may further include a depression 430 which is disposed between the planar platform 426 of the first end 422 and the handle 428 of the second end 424. A first cavity 432 and a second cavity 434 may be disposed in the first actuation member 420 such that the first and second cavities 432, 434 are at least partially disposed in or are in connection with the depression 430. As best shown in FIG. 7, the first and second cavities 432, 434 are shaped to at least partially receive the latch engagement members 270 of the seat support portion 200.

As best illustrated in FIG. 12B, the first actuation member 420 may be disposed on top or above the second actuation member 440 (which is disposed on top of or above the base member 460), where the L-shaped slot 427 at least partially receives the sliding pin 450 (i.e., such that the L-shaped slot 427 engages the sidewall 456 of the sliding pin 450). The first actuation member 420 may further include a biasing member (e.g., a spring) 436, which is best illustrated in FIG. 8, that biases the first actuation member 420 to the unactuated position (i.e., such that the sliding pin 450 is disposed proximate to the first end 427A of the L-shaped slot 427). As explained in further detail below, because of the L-shaped slot 427 and its orientation, the first actuation member 420 may only be actuated or pulled out from the interactive assembly 300 along direction F when the second actuation member 440 is actuated or pulled out from the interactive assembly 300 (along direction E). When the second actuation member 440 is unactuated, the sliding pin 450 remains in the first end 447A of the slanted slot 447 of the second actuation member 440, the first end 469A of the linear slot 469 of the base member 460, and also the first end 427A of the L-shaped slot 427 of the first actuation member 420. Because the portion of the L-shaped slot 427 between the first end 427A and the intermediate corner 427C is orthogonal or oriented perpendicular to the sliding actuation direction F of the first actuation member 420, the sliding pin 450 being positioned in the first end 427A of the L-shaped slot 427 prevents the first actuation member 420 from being actuated or being pulled out of the interactive assembly 300.

However, as previously explained, the when the second actuation member 440 is actuated or pulled out of the interactive assembly 300 along direction E, the sliding pin 450 slides along the slanted slot 447 from the first end 447A to the second end 447B, while also simultaneously sliding along the linear slot 469 of the base member 460 from the first end 469A to the second end 469B of the linear slot 469. When this happens, the sliding pin 450 also simultaneously slides along the L-shaped slot 427 of the first actuation member 420 from the first end 427A to the intermediate corner 427C. Once the sliding pin 450 has slid from the first end 427A to the intermediate corner 427C of the L-shaped slot, the first actuation member 420 may also be actuated or pulled out of the interactive assembly 300 along direction F because the portion of the L-shaped slot 427 between the intermediate corner 427C and the second end 427B is parallel to the sliding actuation direction F of the first actuation member 420 (i.e., the portion of the L-shaped slot 427 between the intermediate corner 427C and the second end 427B is orthogonal to the portion of the L-shaped slot 427 between the first end 427A and the intermediate corner 427C). Thus, when the first actuation member 420 is actuated, the sliding pin 450 slides from the intermediate corner 427C to the second end 427B (while remaining at the second end 447B of the slanted slot 447 of the second actuation member 440 and the second end 469B of the linear slot 469 of the base member 460).

Figure 13A:
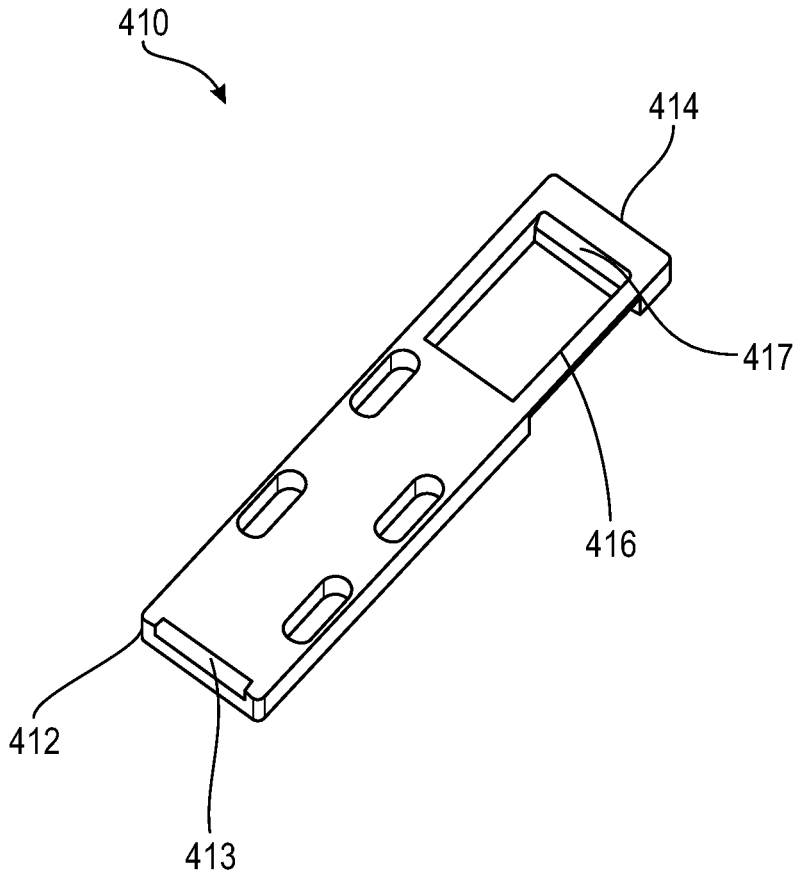
FIG. 13A illustrates a perspective view of the latching member of the latch mechanism illustrated in FIG. 8.
Figure 13B:
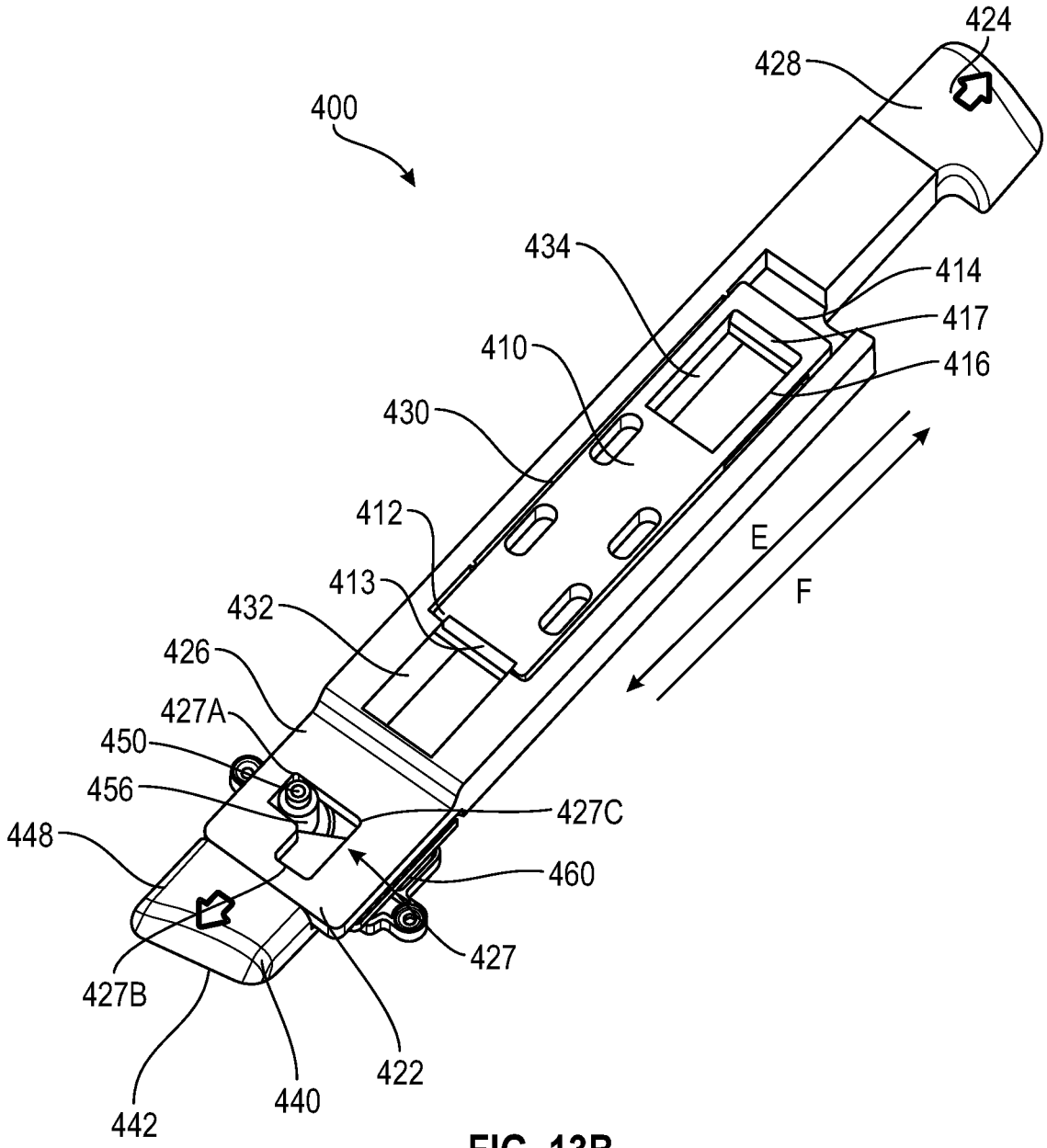
FIG. 13B illustrates a perspective view of the latching member illustrated in FIG. 13A movably coupled to the first actuation member, second actuation member, sliding pin, and base member illustrated in FIG. 12B.

Turning to FIGS. 13A and 13B, and with continued reference to FIGS. 5A, 5B, 7-9, 10A, 10B, 11A, 11B, 12A, and 12B, illustrated is the latching member 410. As illustrated, the latching member 410 contains a first end 412 and an opposite second end 414. The first end 412 may have a ramped edge or ramped surface 413. Disposed proximate to the second end 414 may be an opening 416 with a ramped edge or ramped surface 417 disposed more proximate to the second end 414 than the other edges or surfaces of the opening 416. As best illustrated in FIG. 13B, the latching member 410 may be disposed within the depression 430 of the first actuation member 420 such that the latching member 410 is configured to slide along the depression 430 along direction E or F. The latching member 410 in some situations may slide through the depression 430 of the first actuation member 420 independent of movement of the first actuation member 420 (i.e., when the latch engagement members 270 are inserted past the latching member 410 and into the first and second cavities 432, 434 of the first actuation member 420). The position of the latching member 410 in the depression 430 of the first actuation member 420 that is illustrated in FIG. 13B is the first position or latching position of the latching member 410. As illustrated in FIG. 7, when the latching member 410 is in the latching position, when the first actuation member 420 is in the unactuated position, and when the latch engagement members 270 of the seat support portion 200 are disposed in the first and second cavities 432, 434 of the first actuation member 420, the latching member 410 engages the latch engagement members 270 to retain the latch engagement members 270 in the first and second cavities 432, 434 of the first actuation member 420 (and securing the interactive assembly 300 to the seat support portion 200). When the first actuation member 420 is actuated or pulled out of the interactive assembly 300 (i.e., when it is pulled along the direction F as explained above), the first actuation member 420 causes the latching member 410 to also slide along the direction F until the latching member 410 disengages from the latch engagement members 270 of the seat support portion 200 (i.e., to disengage the rear side 304 of the interactive assembly 300 from the seat support portion 200). However, as explained, previously, when the latch engagement members 270 are inserted past the latching member 410 and into the first and second cavities 432, 434 of the first actuation member 420, the latch engagement members 270 engage the ramped edges 413, 417 to slide the latching member 410 along direction F through the depression 430 of the first actuation member 420. A biasing member 418 may bias the latching member 410 to the latching position shown in FIGS. 7 and 13B so that the latch engagement members 270 of the seat support portion 200 are secured into the first and second cavities 432, 434 of the first actuation member 420 by the latching member 410.

As previously stated, the latch mechanism 400 and associated components 410, 420, 440, 450, 460 described herein may be configured to only release the interactive assembly 300 from the seat support portion 200 via a double actuation. In other words, the latch mechanism 400 may be configured to release the interactive assembly 300 from the seat support portion 200 only when both the first and second actuation members 420, 440 are actuated or pulled out of their respective sides of the interactive assembly 300. Actuating only the first actuation member 420 or only the second actuation member 440 may not facilitate the removal of the interactive assembly 300 from the seat support portion 200. The latch mechanism 400 and associated components 410, 420, 440, 450, 460 described herein may be configured to enable an easy coupling of the interactive assembly 300 to the seat support portion 200 that is still safe to use (i.e., that prevents inadvertent decoupling of the interactive assembly 300 from the seat support portion 200). For example, once the front engagement arms 260 of the seat support portion 200 have been inserted into the front attachment openings 316 of the central cavity 314 of the interactive assembly 300, the rear side 304 of the interactive assembly 300 may simply be pressed upward into the bottom side 212 of the seat support portion 200 such that the latch engagement members 270 are inserted through the first and second latch openings 350, 352, and ultimately into the first and second cavities 432, 434 of the first actuation member 420. The description of the dual actuation latch mechanism 400 is not intended to be limited to the details shown, since it will be apparent that the dual actuation latch mechanism 400 may be utilized to safely and quickly couple one portion of an infant support structure to another portion of an infant support structure. In other words, for example, the dual actuation latch mechanism 400 described herein may be utilized to secure an interactive assembly to a top, a bottom, or any side of an infant support structure.

Figure 14:
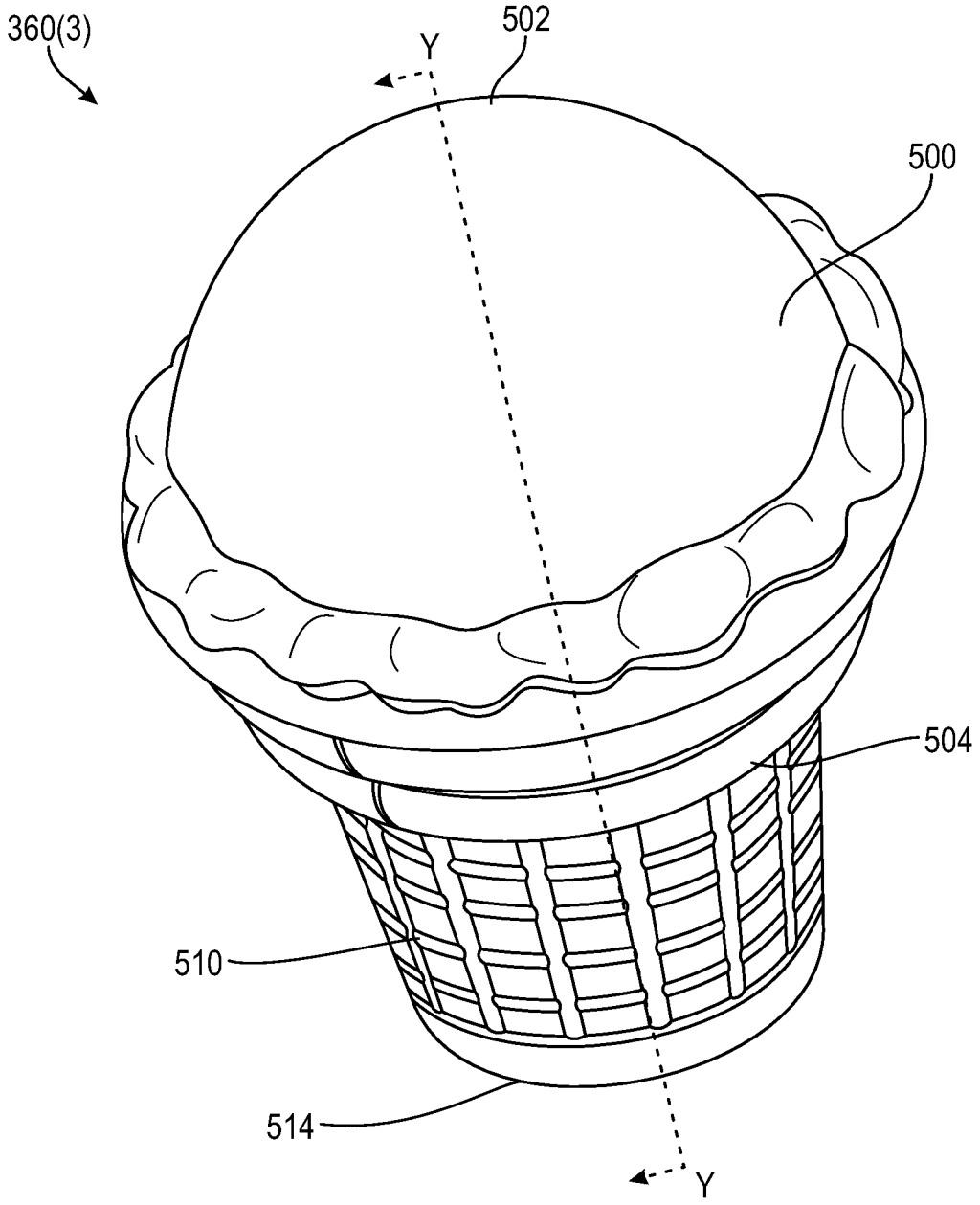
FIG. 14 illustrates a perspective view of a first interactive component of the interactive assembly illustrated in FIG. 5A.
Figure 15:
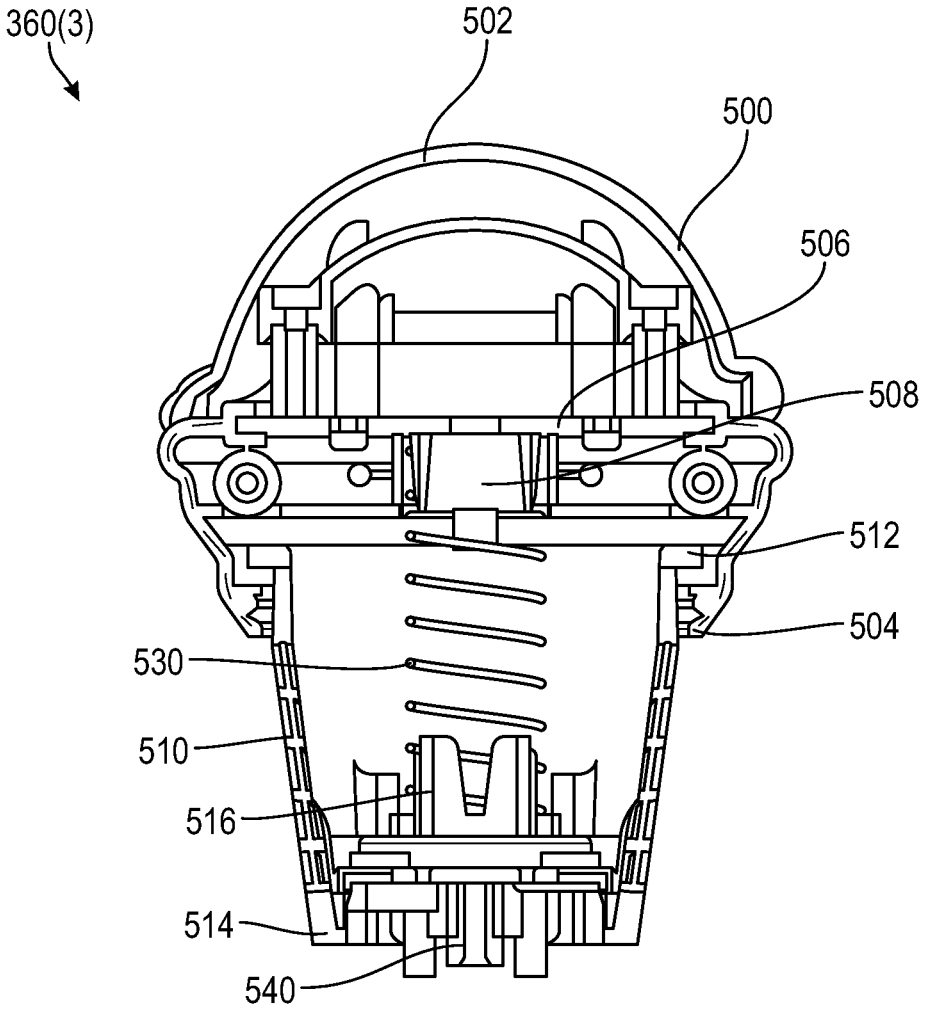
FIG. 15 illustrates a cross-sectional view of the first interactive component illustrated in FIG. 14 taken along line Y-Y.
Figure 16:
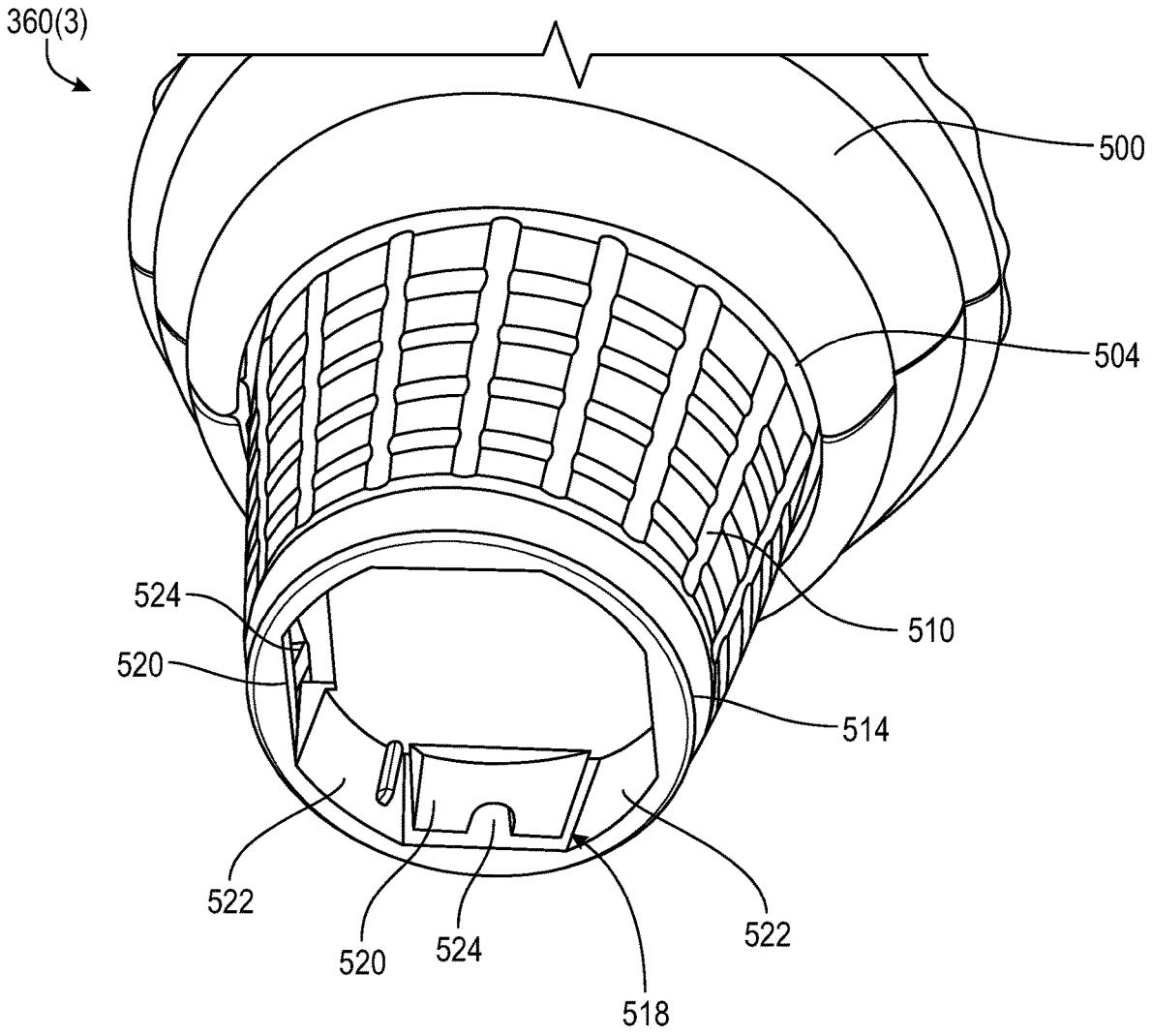
FIG. 16 illustrates a bottom view of the first interactive component illustrated in FIG. 14.

Turning to FIGS. 14, 15, and 16, illustrated is the third interactive component 360(3). The embodiment of the third interactive component 360(3) illustrated may resemble an ice cream cone. The third interactive component 360(3) may contain a first or upper portion 500 and a second or lower portion 510. The upper portion 500 may include a top end 502 and an opposite bottom end 504. As best illustrated in FIG. 15, which is a cross-sectional view of the third interactive component 360(3) taken along line Y-Y in FIG. 14, the upper portion 500 may further include an interior platform 506 disposed between the bottom end 504 and the top end 502. The interior platform 506 may contain a central pillar 508 that extends downwardly from the interior platform 506 toward the bottom end 504. The upper portion 500 may resemble the scoop of ice cream of the ice cream cone.

The lower portion 510, as best illustrated in FIG. 15, may also contain a top end 512 and a bottom end 514. The lower portion 510 may resemble the cone portion of the ice cream cone. The top end 512 may be at least partially disposed within the upper portion 500 via the bottom end 504 of the upper portion. Moreover, as best illustrated in FIG. 5, disposed within the lower portion 510 proximate to the bottom end 514 is a central pillar 516. A resilient member 530 may be coupled to both the central pillar 516 of the lower portion 510 and the central pillar 508 of the upper portion 500, which facilitates the upper portion 500 to move, wobble, or bobble with respect to the lower portion 510.

As best illustrated in FIG. 16, the bottom end 514 of the lower portion 510 may include an opening or cavity 518. The cavity 518 may contain a series of first sidewalls 520 and a series of second sidewalls 522, where the first and second sidewalls 520, 522 are oriented in an alterning manner. As further illustrated in FIG. 16, each of the first sidewalls 520 contain a tab 524.

Figure 17A:
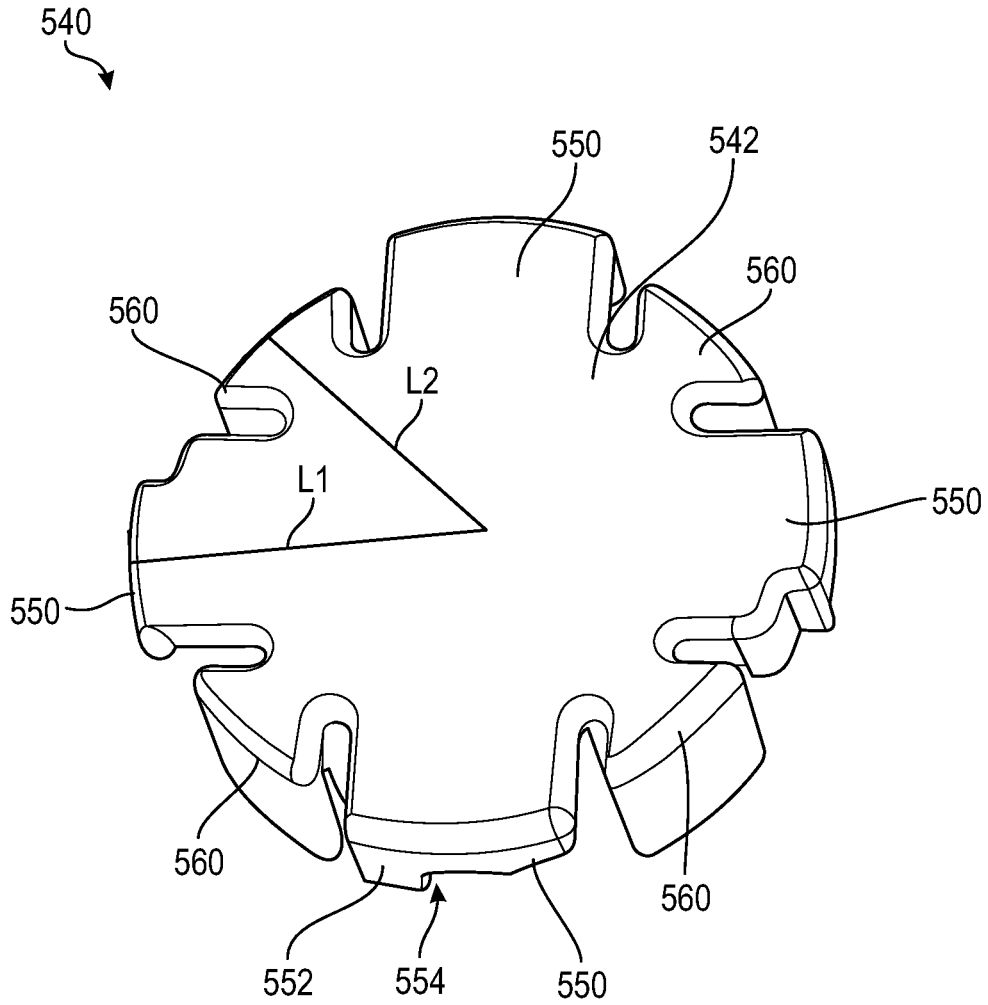
FIG. 17A illustrates a top perspective view of a mounting component of the interactive assembly illustrated in FIG. 5A that is configured to be received by the bottom of the first interactive component illustrated in FIG. 14 to secure the interactive component to the interactive assembly.
Figure 17B:
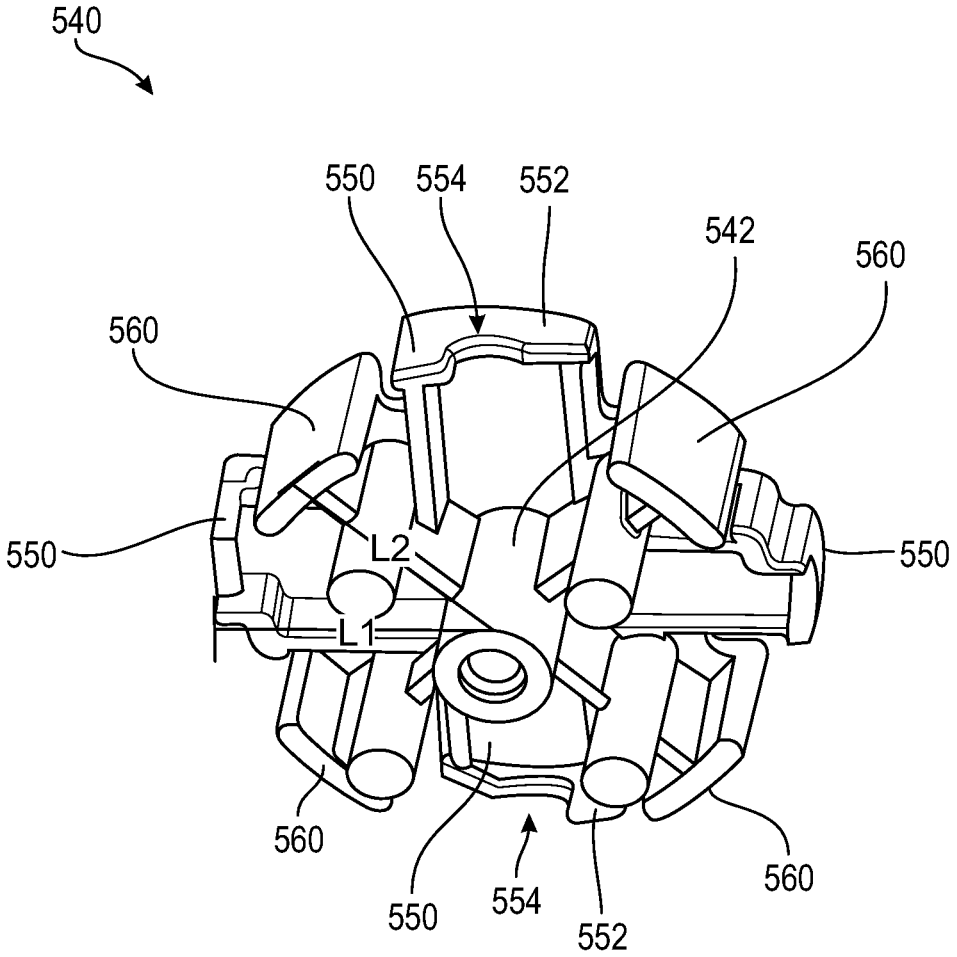
FIG. 17B illustrates a bottom perspective view of the mounting component illustrated in FIG. 17A.
Figure 18:
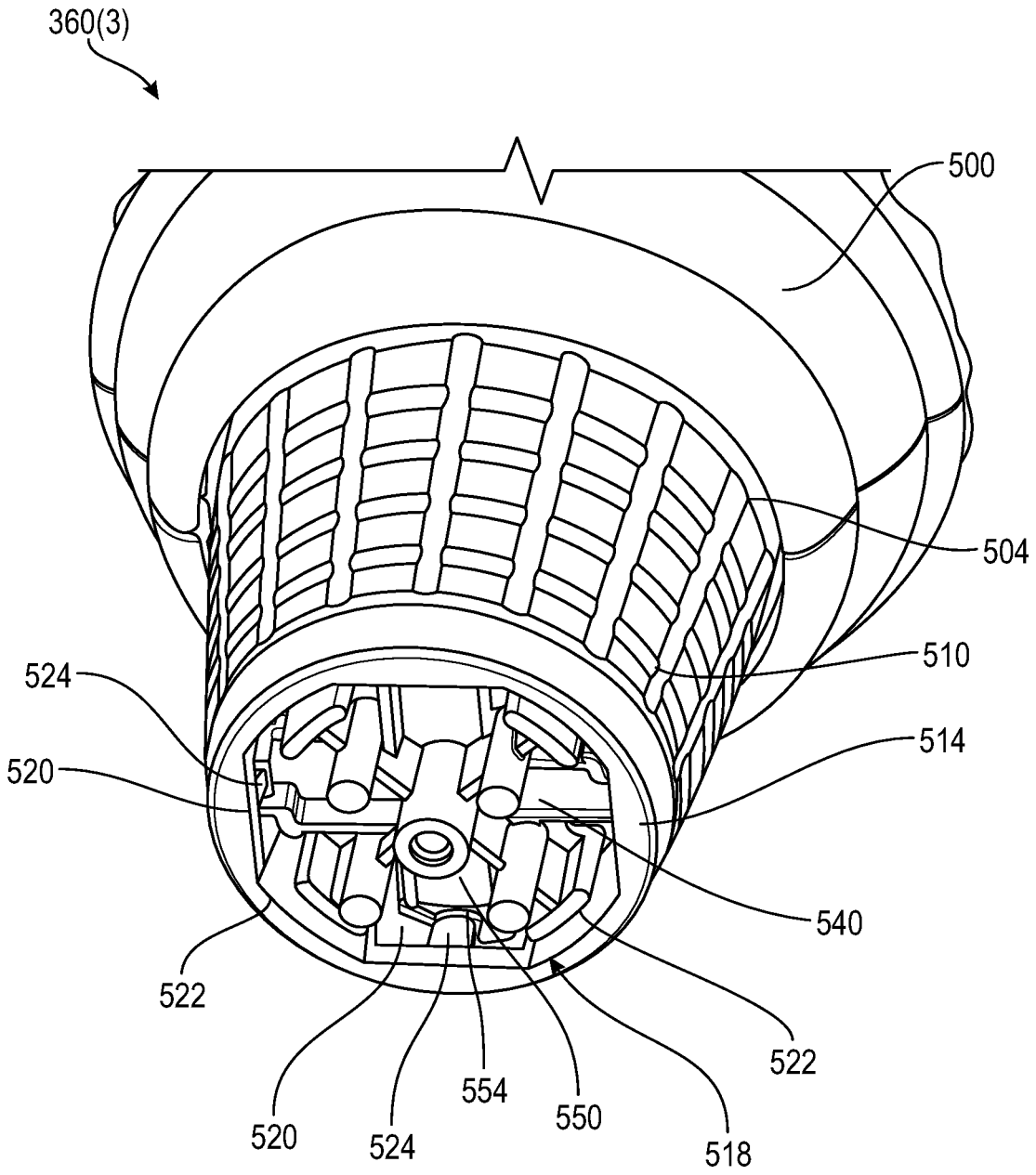
FIG. 18 illustrates a bottom view of the first interactive component illustrated in FIG. 14 coupled to the mounting component illustrated in FIG. 17A.

Turning to FIGS. 17A and 17B, illustrated are perspective views of the attachment base 540 that is configured to be received by the cavity 518 of the lower portion 510 of the third interactive component 360(3). The attachment base 540 may be secured to the interactive assembly 300 and, as explained in further detail below, may be utilized to removably couple the third interactive component 360(3) to the interactive assembly 300. The attachment base 540 may include a central portion 542, a series of first extension members 550 extending from the central portion 542, and a series of second extension members 560 extending from the central portion 542. The first and second extension members 550, 560 may be coupled to and extend from the central portion 542 in an alternating manner about the central portion 542. As illustrated, each of the first extension members 550 may extend from the central portion 542 a first length L1. Moreover, each of the first extension members 550 may contain a sidewall 552 on the end of the first extension members 550, where each of the sidewalls 552 contain a notch 554 that is configured to receive one of the tabs 524 of the cavity 518 of the lower portion 510 of the third interactive component 360(3). Each of the second extension members 560 may extend from the central portion 542 a second length L2, which is less than the first length L1.

In order to secure the third interactive component 360(1) to the attachment base 540, and thus to the interactive assembly 300 when the attachment base 540 is secured to the interactive assembly 300, the third interactive component 360(1) is aligned with the attachment base 540 such that the first extension members 550 of the attachment base 540 are aligned with the second series of sidewalls 522. The lower portion 510 of the third interactive component 360(1) may then be lowered upon the attachment base 540 such that the attachment base 540 is inserted into the cavity 518 of the lower portion 510 of the third interactive component 360(1). Once the attachment base 540 is disposed within the cavity 518, the third interactive component 360(1) may be rotated (e.g., approximately an eighth of a turn) until the first extension members 550 are aligned with, and disposed adjacent or proximate to, the first series of sidewalls 520, and such that the tabs 524 of the first series of sidewalls 520 are received by the notches 554 of the sidewalls 552 of the first extension members 550 of the attachment base.

To uncouple the third interactive component 360(1) from the attachment base 540 (and the interactive assembly 300), the third interactive component 360(1) is rotated in the reverse direction until the tabs 524 are no longer disposed within the notches 554 of the attachment base 540, and until the first extension members 550 are aligned with, and disposed adjacent or proximate to, the second series of sidewalls 522 of the third interactive component 360(1). Then the third interactive component 360(1) may be lifted off of the attachment base 540 so that the attachment base 540 is no longer disposed within the cavity 518 of the lower portion 510 of the third interactive component 360(1).

The attachment base 540 and above described attachment mechanism may be utilized to removably couple any object to the interactive assembly 300.

Figure 19A:
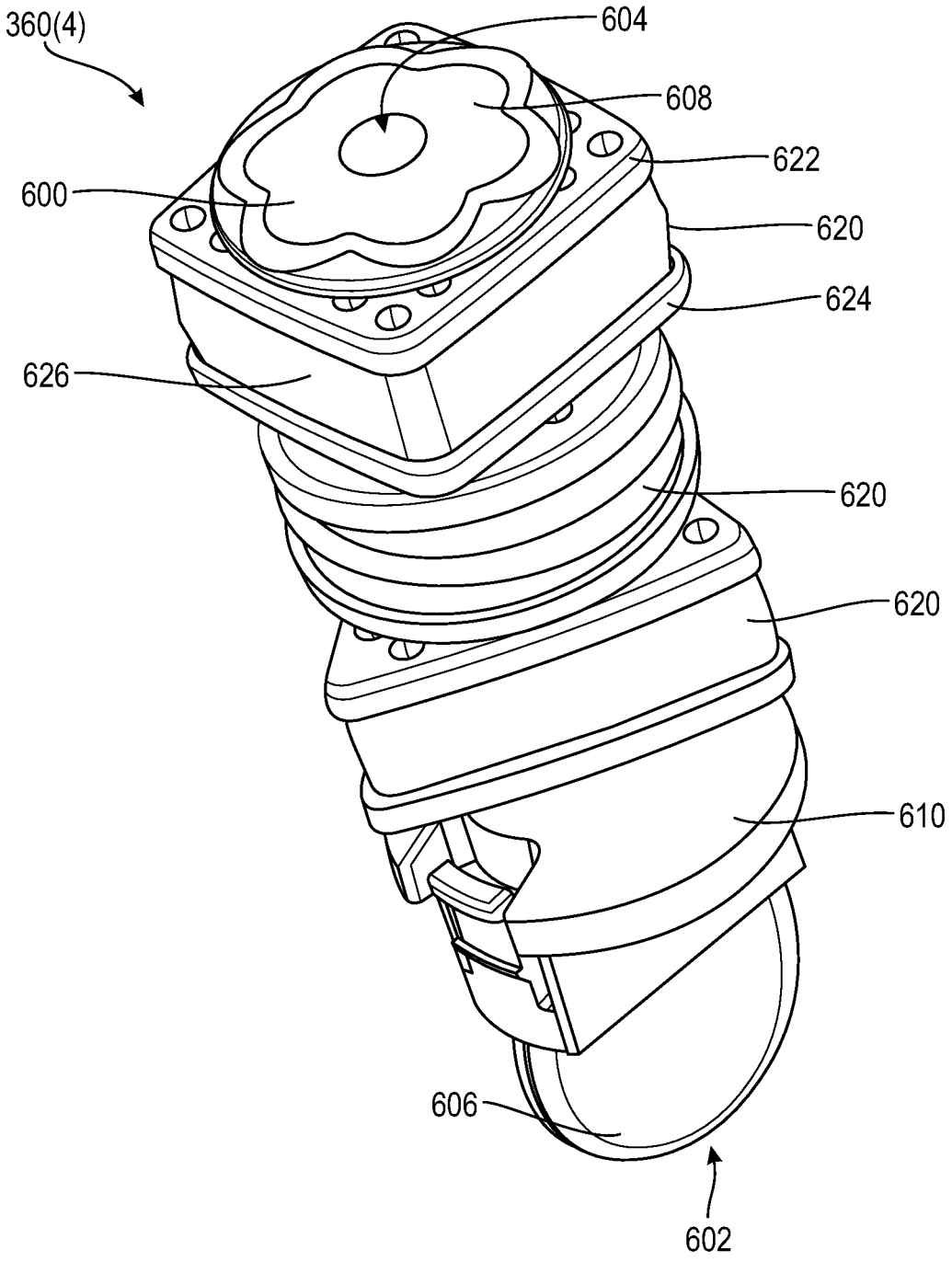
FIG. 19A illustrates a top perspective view of a second interactive component of the interactive assembly illustrated in FIG. 5A.
Figure 19B:
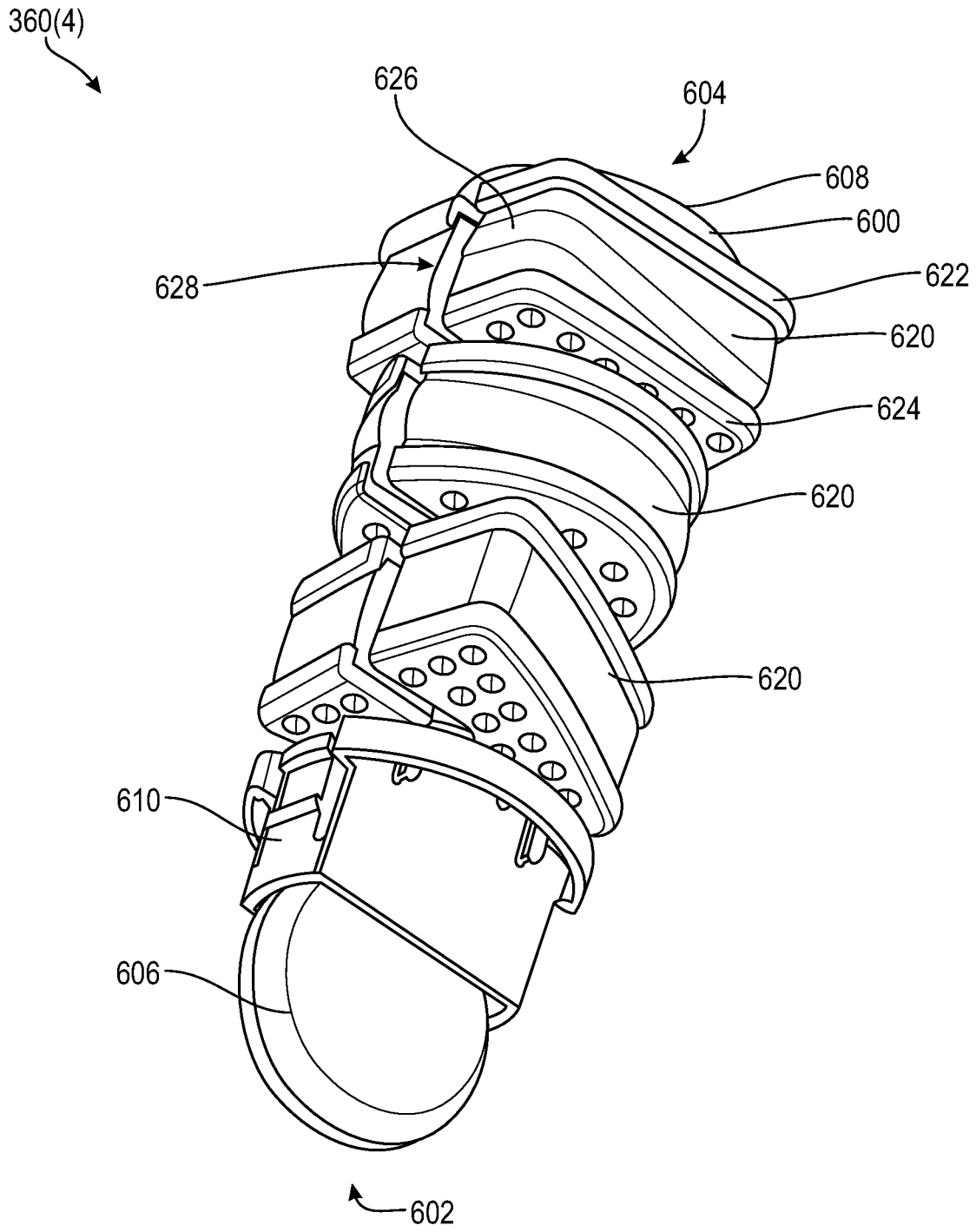
FIG. 19B illustrates a bottom perspective view of the second interactive component illustrated in FIG. 19A.
Figure 20:
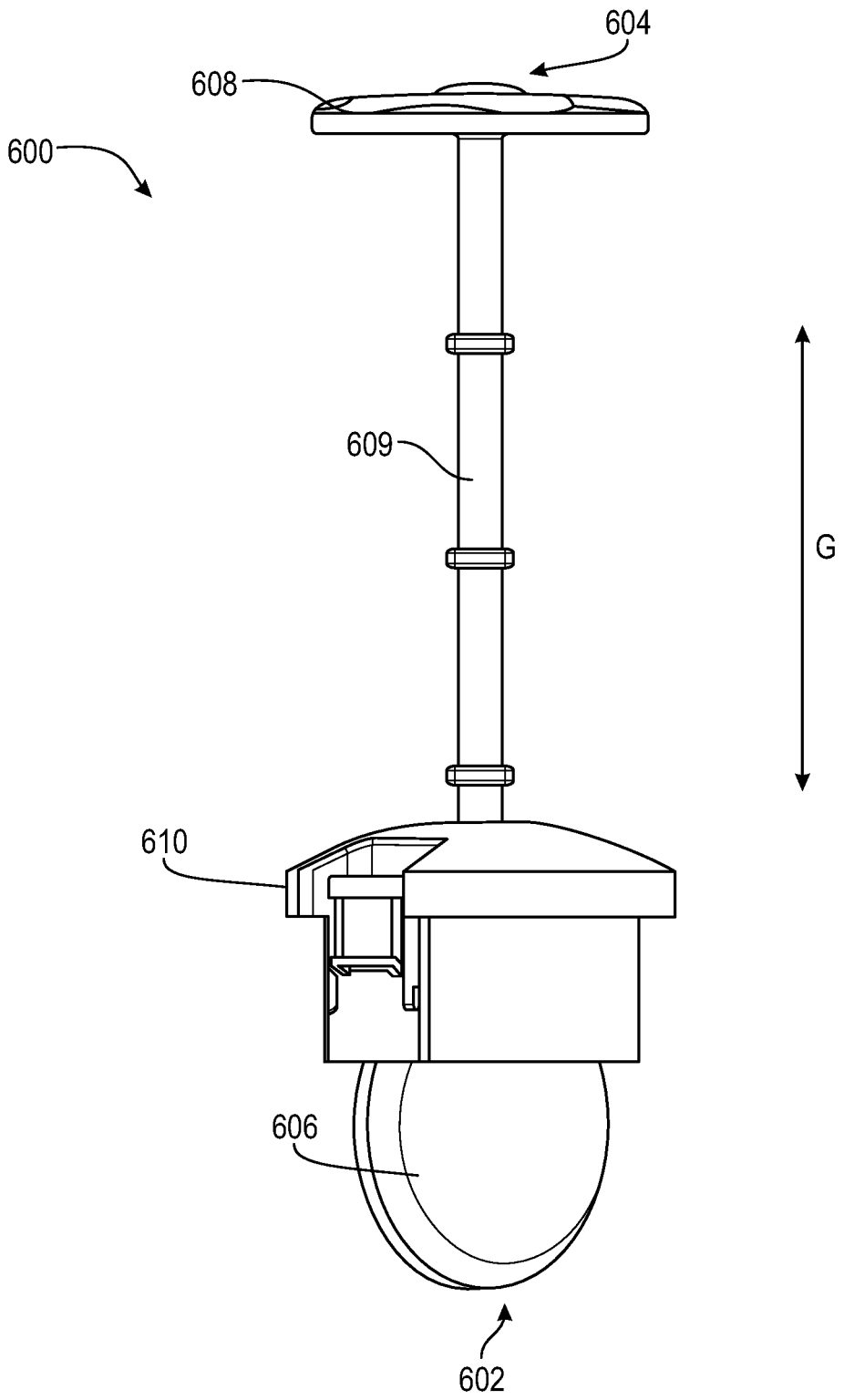
FIG. 20 illustrates a side elevation view of the second interactive component illustrated in FIG. 19A with the interactive elements removed.

Turning to FIGS. 19A, 19B, 20, and 21, illustrated is the fourth interactive component 360(4). The fourth interactive component 360(4) may include a central member 600, a base 610, and a series of interactive elements 620 that may be removably coupled to the central member 600. As best illustrated in FIG. 20, the central member 600 of the fourth interactive component 360(4) may have a proximal end 602 and an opposing distal end 604. The central member 600 may contain a first cap 606 disposed at the proximal end 602, and a second cap 608 disposed at the distal end 604. Extending between the first and second caps 606, 608 is a central pillar 609. As illustrated in FIGS. 19A, 19B, and 20, the central member 600 may be coupled to the base 610 such that the central pillar 609 extends through the base 610 with the first cap 606 disposed under the base 610 and the second cap 608 disposed above the base 610. The central member 600 may slide through the base 610 along direction G depending on whether or not the interactive elements 620 are coupled to the central pillar 609 of the central member 600. Thus, when the interactive elements 620 are coupled to the central pillar 609 of the central member 600, the first cap 606 may be disposed proximate to the base 610, but when the interactive elements 620 are uncoupled from the central pillar 609 of the central member 600, the central member 600 may slide along the direction G such that the second cap 608 is disposed proximate to the base 610 (not shown). The base 610 may be configured to snap onto the interactive assembly 300 to secure the fourth interactive component 360(4) to the interactive assembly 300.

Figure 21:
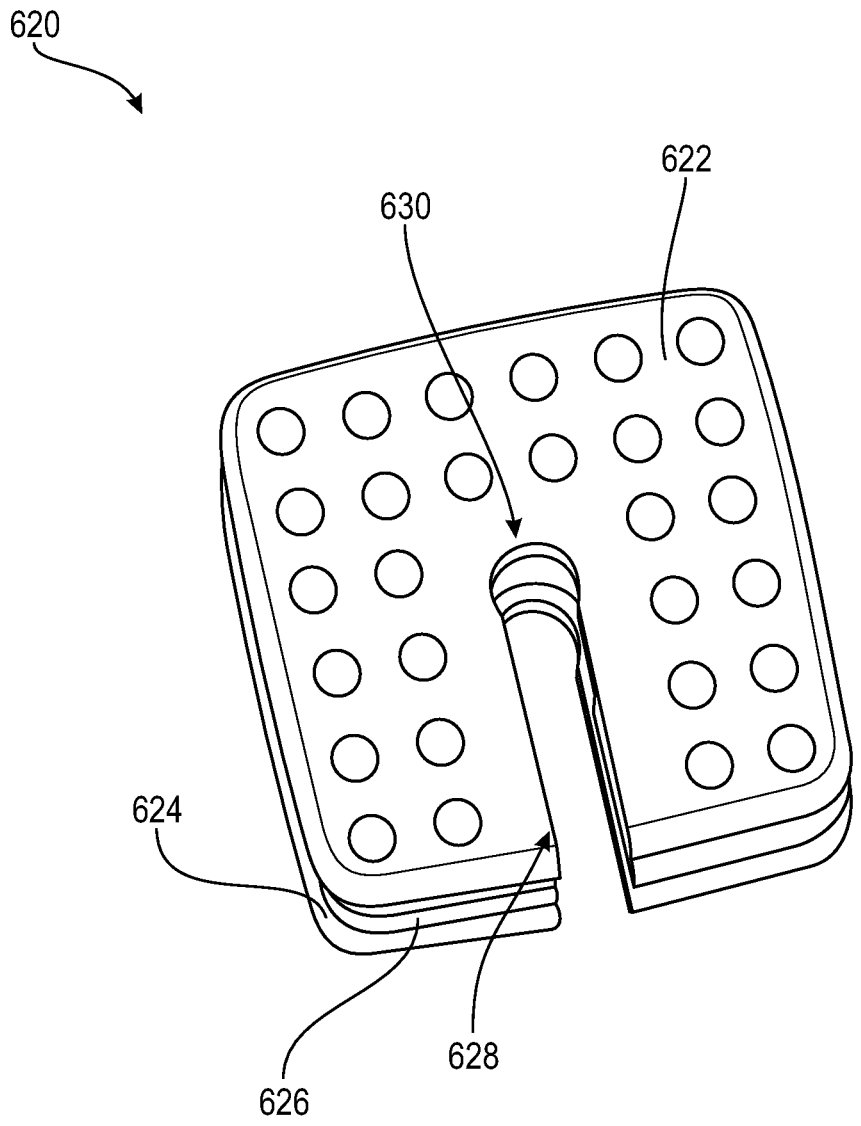
FIG. 21 illustrates a top view of one of the interactive elements of the second interactive component illustrated in FIG. 19A.

While FIGS. 19A and 19B illustrate that the fourth interactive component 360(4) contains three interactive elements 620, other embodiments of the fourth interactive component 360(4) may contain any number of interactive elements 620. Moreover, while FIG. 21 illustrates only one interactive element 620, because the interactive elements are similar to one another (and only differ in their color and/or outermost shape), the description of the interactive element 620 illustrated in FIG. 21 applies to the other interactive elements 620 illustrated in FIGS. 19A and 19B. As illustrated in FIGS. 19A, 19B, and 21, the interactive element 620 includes a top side 622 and a bottom side 624 opposite the top side 622. The interactive element further includes sidewalls 626 extending from the top side 622 to the bottom side 624. As best illustrated in FIG. 21, extending through the top and bottom sides 622, 624 from one of the sidewalls 626 is a slit or slot 628. The slot 628 extends into the interactive element 620 to a central opening 630 that extends through the interactive element 620 from the top side 622 to the bottom side 624. As illustrated, the width of the slot 628 is less than the diameter of the central opening 630. The diameter of the central opening 630 may be slightly larger or equal to the diameter of the central pillar 609 of the central member 600, while the width of the slot 628 may be slightly smaller than the diameter of the central pillar 609.

Thus, in order to attach the interactive elements 620 to the central member 600, a user may use force to slide the central pillar 609 of the central member 600 through the slot 628 of the interactive elements 620 until the central pillar 609 of the central member 600 is disposed within the central opening 630. With the width of the slot 628 being slightly smaller than the diameter of the central pillar 609 of the central member 600, the central pillar 609 will remain in the central opening 630 (and the interactive element 620 will remain attached to the central member 600) until the user forces the central pillar 609 to slide through the slot 628. The interactive elements 620 may be removed from the central member 600 and utilized with the shape sorting compartment 340 of the interactive assembly 300.

While the apparatuses and methods presented herein have been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. For example, the infant support structures/apparatuses presented herein may be modified to contain any number of upstanding frame members, seat supports, interactive assemblies, interactive components, interactive elements, etc. Moreover, the infant support structures/apparatuses presented herein may be modified to resemble any other structure, vehicle, animal, device, etc. Additionally, the methods presented herein may be suitable for attaching any type of interactive assembly to a seat support.

In addition, various features from one of the embodiments may be incorporated into another of the embodiments. That is, it is believed that the disclosure set forth above may encompass multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and sub combinations of the various elements, features, functions, and/or properties disclosed herein. Accordingly, it is appropriate that the appended claims be construed broadly and in a manner consistent with the scope of the disclosure as set forth in the following claims.

It is also to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention. Additionally, it is also to be understood that the infant support structures/apparatuses described herein, and any portions thereof, may be fabricated from any suitable material or combination of materials, such as plastic, metals, composites, etc., as well as derivatives thereof, and combinations thereof. In addition, it is further to be understood that the steps of the methods described herein may be performed in any order or in any suitable manner.

Finally, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about", "around", "generally", and "substantially."

What is claimed is:

1. An infant support structure comprising:

a frame;

a first portion containing a seat configured to receive an infant;

at least one resilient member coupling the first portion to the frame, the at least one resilient member being configured to facilitate movement of the first portion with respect to the frame; and a second portion removably coupled to the first portion via a latch mechanism that is operatively disposed within the second portion, the second portion being suspended above a support surface when coupled to the first portion, and the second portion being configured to be disposed on the support surface when uncoupled from the first portion.

2. The infant support structure of claim 1, wherein, when the second portion is coupled to the first portion, the second portion is disposed underneath the first portion.

3. The infant support structure of claim 1, wherein, when the second portion is coupled to the first portion, the at least one resilient member is further configured to facilitate movement of the second portion with respect to the frame.

4. The infant support structure of claim 1, wherein the second portion has a shape of a toy vehicle and is configured to receive an infant when the second portion is uncoupled from the first portion and disposed on the support surface.

5. The infant support structure of claim 1, wherein the latch mechanism requires a dual actuation to facilitate uncoupling the second portion from the first portion.

6. The infant support structure of claim 1, wherein the first portion contains an engagement member extending from the first portion.

7. The infant support structure of claim 6, wherein the second portion contains an opening configured to receive the engagement member of the first portion when the second portion is coupled to the first portion.

8. An infant support structure comprising:

a frame;

a seat support configured to receive an infant, the seat support being suspended from the frame above a support surface; and an interactive assembly removably coupled to the seat support via a latch mechanism that is operatively disposed within the interactive assembly, the interactive assembly configured to provide a first play pattern when coupled to the seat support and a second play pattern when uncoupled from the seat support and disposed on the support surface, wherein the interactive assembly, when uncoupled from the seat support and disposed on the support surface is configured to surround an infant disposed on the support surface.

9. The infant support structure of claim 8, wherein the seat support is suspended from the frame via a resilient member that is configured to facilitate movement of the seat support with respect to the frame.

10. The infant support structure of claim 9, wherein, when the interactive assembly is coupled to the seat support, the resilient member is further configured to facilitate movement of the interactive assembly with respect to the frame.

11. The infant support structure of claim 8, wherein the interactive assembly has a shape of a toy vehicle configured to receive an infant when the interactive assembly is uncoupled from the seat support and disposed on the support surface.

12. The infant support structure of claim 8, wherein the latch mechanism requires a dual actuation to facilitate uncoupling the interactive assembly from the seat support.

13. The infant support structure of claim 8, wherein the seat support contains an engagement member extending from the seat support.

14. The infant support structure of claim 13, wherein the interactive assembly contains an opening configured to receive the engagement member of the seat support when the interactive assembly is coupled to the seat support.

15. An infant support structure comprising:

a frame;

a seat support configured to receive an infant, the seat support being suspended from at least a portion of the frame such that the seat support is suspended above a support surface; and an interactive assembly removably coupled to the seat support via a latch mechanism that is operatively disposed within the interactive assembly, the infant support structure being reconfigured between a first configuration, where the interactive assembly is coupled to the seat support and suspended above the support surface, and a second configuration, where the seat support remains suspended above the support surface and the interactive assembly is uncoupled from the seat support and disposed on the support surface.

16. The infant support structure of claim 15, wherein the seat support is suspended from the portion of the frame via a resilient member that is configured to facilitate movement of the seat support with respect to the frame.

17. The infant support structure of claim 16, wherein, when the infant support structure is in the first configuration, the resilient member is further configured to facilitate movement of the interactive assembly with respect to the frame.

18. The infant support structure of claim 15, wherein the interactive assembly has a shape of a toy vehicle configured to receive an infant when uncoupled from the seat support and disposed on the support surface.

19. The infant support structure of claim 15, wherein the seat support contains an engagement member extending from the seat support, and wherein the interactive assembly contains an opening configured to receive the engagement member of the seat support when the interactive assembly is coupled to the seat support.

20. The infant support structure of claim 15, wherein the latch mechanism requires a dual actuation to facilitate uncoupling the interactive assembly from the seat support.

* * * * *